US007691553B2

(12) United States Patent
Ariyoshi et al.

(10) Patent No.: US 7,691,553 B2
(45) Date of Patent: Apr. 6, 2010

(54) METHOD FOR MANUFACTURING TONER

(75) Inventors: Satoru Ariyoshi, Nara (JP); Yoshitaka Kawase, Nara (JP); Yoritaka Tsubaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 336 days.

(21) Appl. No.: 11/727,297

(22) Filed: Mar. 26, 2007

(65) Prior Publication Data

US 2007/0224533 A1 Sep. 27, 2007

(30) Foreign Application Priority Data

Mar. 27, 2006 (JP) ..... P2006-086642

(51) Int. Cl.
*G03G 9/08* (2006.01)

(52) U.S. Cl. ..... 430/137.1; 430/137.18

(58) Field of Classification Search ..... 430/137.1, 430/137.18

See application file for complete search history.

(56) References Cited

U.S. PATENT DOCUMENTS

| | | | | |
|---|---|---|---|---|
| 5,180,649 | A | 1/1993 | Kukimoto et al. | |
| 5,460,914 | A | 10/1995 | Sasaki et al. | |
| 5,863,692 | A | 1/1999 | Nakamura et al. | |
| 6,316,157 | B1 | 11/2001 | Yoshikawa et al. | |
| 2004/0146309 | A1 | 7/2004 | Shu et al. | |
| 2005/0196692 | A1 * | 9/2005 | Yamashita et al. | 430/108.3 |
| 2005/0202336 | A1 * | 9/2005 | Kawase et al. | 430/137.1 |
| 2009/0017395 | A1 | 1/2009 | Ariyoshi et al. | |
| 2009/0029279 | A1 | 1/2009 | Mori et al. | |

FOREIGN PATENT DOCUMENTS

| | | | |
|---|---|---|---|
| JP | 2-221967 | | 9/1990 |
| JP | 3-219262 | | 9/1991 |
| JP | 5-19527 | | 1/1993 |
| JP | 5-181322 | A | 7/1993 |
| JP | 9-197704 | A | 7/1997 |
| JP | 10-90951 | A | 4/1998 |
| JP | 10-312089 | | 11/1998 |
| JP | 11-295922 | A | 10/1999 |
| JP | 11-295925 | A | 10/1999 |
| JP | 2000-10349 | A | 1/2000 |
| JP | 2001-142258 | | 5/2001 |
| JP | 2001-265048 | | 9/2001 |
| JP | 2002-189315 | | 7/2002 |

(Continued)

*Primary Examiner*—John L Goodrow
(74) *Attorney, Agent, or Firm*—Nixon & Vanderhye P.C.

(57) ABSTRACT

A kneaded material obtained by heating and melt-kneading a toner composition and a water-based medium containing water are put into a container of a granulating apparatus, and heated by a heater while agitating, to disperse the kneaded material into the water-based medium in its softened state. A temperature at which a loss tangent value of the kneaded material reaches a predetermined loss tangent value A, specifically, 0.5 or more and less than 5.0, is inputted to a granulating temperature input section as a setting granulating temperature T1. The heater is then controlled by a control section so that a granulating temperature as a temperature of the water-based medium measured by a thermometer reaches the setting granulating temperature T1 inputted to the input section. Accordingly, the granulating temperature as a temperature of the water-based medium, and thus a temperature of the kneaded material in the water-based medium is adjusted to T1.

3 Claims, 4 Drawing Sheets

FOREIGN PATENT DOCUMENTS

| | | | |
|---|---|---|---|
| JP | 2002-244348 | A | 8/2002 |
| JP | 2002-258523 | A | 9/2002 |
| JP | 2004-013049 | | 1/2004 |
| JP | 2004-191546 | | 7/2004 |
| JP | 2004-258625 | | 9/2004 |
| JP | 2005-181849 | A | 7/2005 |
| JP | 2005-316055 | A | 11/2005 |
| JP | 2006-84742 | A | 3/2006 |
| JP | 2006-113313 | | 4/2006 |
| JP | 2006-293160 | A | 10/2006 |
| JP | 2007-41496 | A | 2/2007 |
| JP | 2007-58134 | A | 3/2007 |

* cited by examiner

METHOD FOR MANUFACTURING TONER

CROSS-REFERENCE TO RELATED APPLICATION

This application claims priority to Japanese Patent Application No. 2006-86642, which was filed on Mar. 27, 2006, the contents of which, are incorporated herein by reference, in their entirety.

BACKGROUND OF THE INVENTION

1. Field of the Invention

The present invention relates to a method for manufacturing a toner for use in development of an electrostatic latent image in image formation by an electrophotographic method.

2. Description of the Related Art

In the electrophotographic method, an image is formed as follows. A surface of an electrophotographic photoreceptor (hereinafter also referred to as merely a "photoreceptor") is charged, and then exposed to light to form an electrostatic latent image, and a toner is electrostatically attracted onto the surface of the photoreceptor to develop the electrostatic latent image, and a toner image obtained is transferred from the surface of the photoreceptor to a recording medium such as a sheet of paper and fixed. The toner is charged by a frictional charge, transported by a developer bearing member such as a developing roller, and supplied onto the surface of the photoreceptor. The toner that remains on the surface of the photoreceptor without being transferred onto the recording medium is physically scraped by a removing section to be removed from the surface of the photoreceptor.

As the removing section of a toner, a cleaning blade is used due to its simple configuration and its good removing capability. The cleaning blade removes a toner by sliding and scrubbing on the surface of the photoreceptor to scrape toner particles constituting the toner. At this time, the more a shape of the toner particles is similar to a true spherical shape, the less rolling friction force acting on the toner particles from the photoreceptor and the cleaning blade is. Therefore, so-called poor cleaning, in which the toner particles roll in a space between the photoreceptor and the cleaning blade to slip through the cleaning blade, and remain on the surface of the photoreceptor without being scraped by the cleaning blade, has a tendency to occur. In addition, the smaller a particle diameter of the toner particles becomes, the more easily the toner particles enter the space between the photoreceptor and the cleaning blade. Accordingly, the smaller the particle diameter of the toner particles becomes to obtain high image quality, the more easily the poor cleaning has a tendency to occur. Therefore, in order to prevent occurrence of the poor cleaning and to improve a cleaning capability of a toner, the toner particles preferably have a shape (hereinafter also referred to as an "irregular shape") out of the true spherical shape.

As described above, it is preferable that the toner particles have a shape out of the true spherical shape in terms of the cleaning capability. However, the more the toner particles have a shape similar to the true spherical shape, the more preferable in terms of a flow property. When the toner particles have a shape significantly out of the true spherical shape, the flow property of the toner is decreased to cause an uneven charge amount, compared with a case in which the toner particles have a shape similar to the true spherical shape. Accordingly, scattering of the toner and fogging on an image because of the scattering may occur. In addition, the toner may not be stably supplied onto the surface of the photoreceptor, thus preventing development thereof. Therefore, in order to achieve a toner balancing between the cleaning capability and the flow property, it is preferable that the toner particles have a shape (hereinafter referred to as an "approximately spherical shape") slightly out of the true spherical shape.

Examples of a method for manufacturing a toner include a so-called pulverization method, in which for example a toner composition containing at least a colorant and a binder resin is kneaded to produce a kneaded material, and then the kneaded material obtained is solidified and directly pulverized to obtain toner particles (refer to Japanese Unexamined Patent Publications JP-A 5-249735 (1993), p. 11, and JP-A 8-234480 (1996), p. 15, for example). In the pulverization method, the kneaded material is solidified and directly pulverized to obtain toner particles. Accordingly, it is difficult to control a toner particle shape, and it is thus difficult to manufacture toner particles having the approximately spherical shape.

Examples of a method for manufacturing a toner other than the pulverization method include polymerization methods such as a suspension polymerization method and an emulsion polymerization method. In the polymerization method, a binder resin monomer containing a colorant is dispersed into water, and then polymerized to obtain toner particles. As described above, in the polymerization method, toner particles are produced in water, resulting that the toner particles have a tendency to have a shape similar to the true spherical shape that is stable in water. In the polymerization method, examples of a method for producing toner particles having the irregular shape include, a method in which a monomer capable of cross-linking is used as the binder resin monomer, and the monomer is polymerized in water to produce toner mother particles having a shape similar to the true spherical shape, and the toner mother particles are subjected to a cross-linking reaction to partially cross-link the binder resin, thereby obtaining the toner particles having the irregular shape; and a method in which toner particles having a shape similar to the true spherical shape are once produced in water, and the toner particles obtained are subjected to shear force to obtain the toner particles having the irregular shape (refer to Japanese Unexamined Patent Publication JP-A 2005-173578, for example).

In the method for producing toner particles having the irregular shape by the cross-linking reaction, a shape of the toner particles is changed depending on a degree of cross-linking, though it is difficult to control the degree of cross-linking. Accordingly, it is difficult to manufacture toner particles having the approximately spherical shape. In addition, in the method for producing toner particles having the irregular shape by shear force, there has been a problem in which it is necessary to create a step for producing the toner particles having the irregular shape after producing the toner particles by conventional polymerization methods or the like, thus making manufacturing steps complicated. Moreover, the degree of cross-linking depends on the shear force, though it is difficult to finely control the shear force, and it is thus difficult to manufacture toner particles having the approximately spherical shape.

Furthermore, as another method for producing toner particles having the irregular shape, there is an emulsion flocculation method (refer to Japanese Examined Patent Publication JP-B2 3435586, p. 5, for example). In the emulsion flocculation method, a binder resin monomer is emulsified and polymerized in water to produce resin particles having a diameter smaller than that of objective toner particles, and then a water dispersion of the resin particles obtained is mixed with a water dispersion of colorant particles or the like to flocculate the resin particles together with the colorant particles, to produce botryoidal toner particles. In the emulsion flocculation method, there has been a problem in which it is necessary to have a step for flocculating the resin particles after once producing the resin particles, thus making manufacturing steps complicated. In addition, it is extremely difficult to control a degree of flocculation of the resin particles and the colorant particles in order to control a shape of the toner particles.

As described above, in any method of the pulverization method, the polymerization method, and the emulsion flocculation method, it is difficult to control a shape of toner particles, and it is thus difficult to manufacture toner particles having the approximately spherical shape.

SUMMARY OF THE INVENTION

An object of the invention is to provide a method for manufacturing a toner, capable of readily manufacturing toner particles having an approximately spherical shape.

The invention provides a method for manufacturing a toner comprising a kneading step for heating and melt-kneading a toner composition containing at least a binder resin and a colorant to produce a kneaded material in which at least the colorant is dispersed in the binder resin; and a granulating step for mixing the kneaded material with a water-based medium, and then a mixture obtained is heated to disperse the kneaded material into the water-based medium in a state in which the kneaded material is softened, wherein a granulating temperature at the granulating step is a temperature at which a loss tangent obtained by dividing a loss elastic modulus G" of the kneaded material by a storage elastic modulus G' reaches a predetermined loss tangent value A.

According to the invention, at the kneading step, the toner composition containing at least the binder resin and the colorant is heated and melt-kneaded to produce the kneaded material in which at least the colorant is dispersed in the binder resin. The kneaded material obtained at the kneading step is mixed with the water-based medium at the granulating step, and then the mixture obtained is heated to disperse the kneaded material into the water-based medium in a state in which the kneaded material is softened, and thereby particles are formed to produce toner particles. The granulating temperature at the granulating step is obtained by measuring a temperature of the water-based medium, and is also a temperature at which the loss tangent value of the kneaded material reaches the predetermined loss tangent value (hereinafter also referred to as a "setting loss tangent value") A. The loss tangent is a value G"/G' obtained by dividing the loss elastic modulus G" of the kneaded material by the storage elastic modulus G'. Therefore, the larger the loss tangent of the kneaded material is, the higher a ratio of the loss elastic modulus G" thereof is. It follows that a ratio of a viscous component thereof is high, causing a tendency of plastic deformation. The kneaded material is dispersed into the water-based medium in a state in which the kneaded material is softened, to produce toner particles. Accordingly, the toner particles have a viscoelastic character identical to that of the kneaded material obtained at the kneading step, and susceptibility to plastic deformation of the toner particles is expressed by the loss tangent value of the kneaded material obtained at the kneading step.

As described above, the loss tangent value of the kneaded material obtained at the kneading step provides an indication of the susceptibility to plastic deformation of the toner particles at the granulation step. Therefore, a value that the toner particles are formed to be the approximately spherical shape or a spherical shape is defined as the setting loss tangent value A, and the granulating temperature is set to a temperature at which the loss tangent value reaches the setting loss tangent value A. Accordingly, a degree of plastic deformation of the toner particles as kneaded material particles is controlled, to easily manufacture the toner particles having the approximately spherical shape. Accordingly, the cleaning capability of a toner is improved, thus preventing occurrence of the poor cleaning. In addition, the flow property is also improved, thus providing a stable charge amount, and a toner capable of being stably supplied to an image bearing member is obtained. The expression, "the toner particles have the approximately spherical shape", means that an average spherical degree of the toner particles is 0.90 or more and 0.97 or less. The expression, "the toner particles have the spherical shape", means that the average spherical degree of the toner particles is more than 0.97 and less than 1.00. The expression, "the toner particles have the true spherical shape", means that the average spherical degree of the toner particles is 1.00.

Furthermore, in the invention, it is preferable that the loss tangent of the kneaded material is measured at a setting frequency of 0.1 Hz, and the predetermined loss tangent value is 0.5 or more and less than 5.0.

According to the invention, the granulating temperature as a temperature of the water-based medium at the granulating step is set to a temperature at which the loss tangent value of the kneaded material vibrated and measured at the setting frequency of 0.1 Hz reaches the setting loss tangent value A of 0.5 or more and less than 5.0, to obtain toner particles having the approximately spherical shape. When the setting loss tangent value A is 5.0 or more, the toner particles have an undesired excessive susceptibility to plastic deformation, resulting that the average spherical degree of the toner particles may possibly exceed 0.97 and a shape of the toner may possibly become similar to the true spherical shape. As described above, when a toner is scraped and removed from the image bearing member by cleaning members such as a cleaning blade, the use of toner particles having a shape similar to the true spherical shape may possibly reduce rolling friction force acting on the toner particles, decreasing the cleaning property of the toner. When the setting loss tangent value A is less than 0.5, plastic deformation of the toner particles hardly occurs at the granulating step, resulting that the average spherical degree of the toner particles may be less than 0.90 to decrease the flow property of the toner.

Furthermore, in the invention, it is preferable that the granulating temperature at the granulating step is adjusted to a temperature at which the loss elastic modulus G" of the kneaded material reaches a range of from $10^3$ Pa to $10^5$ Pa at a setting frequency of 0.1 Hz.

According to the invention, the granulating temperature as a temperature of the water-based medium at the granulating step is a temperature at which the loss elastic modulus G" of the kneaded material vibrated and measured at a setting frequency of 0.1 Hz reaches a range of from $10^3$ Pa to $10^5$ Pa. When the granulating temperature is a temperature at which the loss elastic modulus G" exceeds $10^5$ Pa, the kneaded material has a tendency to be less softened at the granulating step. Accordingly, force suitable for granulation such as the shear force is increased to become difficult in the granulation of the toner particles. In addition, when the granulation temperature is a temperature at which the loss elastic modulus G" reaches less than $10^3$ Pa, the kneaded material is too softened. Accordingly, toner materials other than the binder resin, which are dispersed in the binder resin, for example a colorant, may be possibly flocculated, thus decreasing dispersibility thereof. Moreover, the toner materials other than the binder resin may be possibly desorbed from the binder resin to the water-based medium to change a content of each toner material in the toner particles from a content of each toner material in the kneaded material obtained at the kneading step. In particular, when a release agent is desorbed from the kneaded material, a fixing property of the toner is decreased. On the other side, as describes above, the granulating temperature is set to a temperature at which the loss elastic modulus G" of the kneaded material vibrated and measured at a setting frequency of 0.1 Hz reaches $10^3$ Pa or more and $10^5$ Pa or less, to facilitate the granulation of the toner particles. Accordingly, the toner particles having the approximately spherical shape are more easily manufactured. In addition, the toner materials other than the binder resin are prevented from being flocculated in the binder resin and desorbed from the binder resin.

Furthermore, in the invention, it is preferable that the toner composition further comprises a release agent, wherein the granulating temperature at the granulating step is lower than a melting point of the release agent.

According to the invention, the granulating temperature as a temperature of the water-based medium at the granulating step is set to a temperature lower than the melting point of the release agent, to allow a decrease in an amount of the release agent desorbed from the kneaded material. Therefore, a temperature range capable of fixing without causing a low-temperature offset phenomenon and a high-temperature offset phenomenon is prevented from becoming narrow. In addition, occurrence of the toner filming caused by the desorbed release agent attaching to a surface of the toner particles is prevented.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
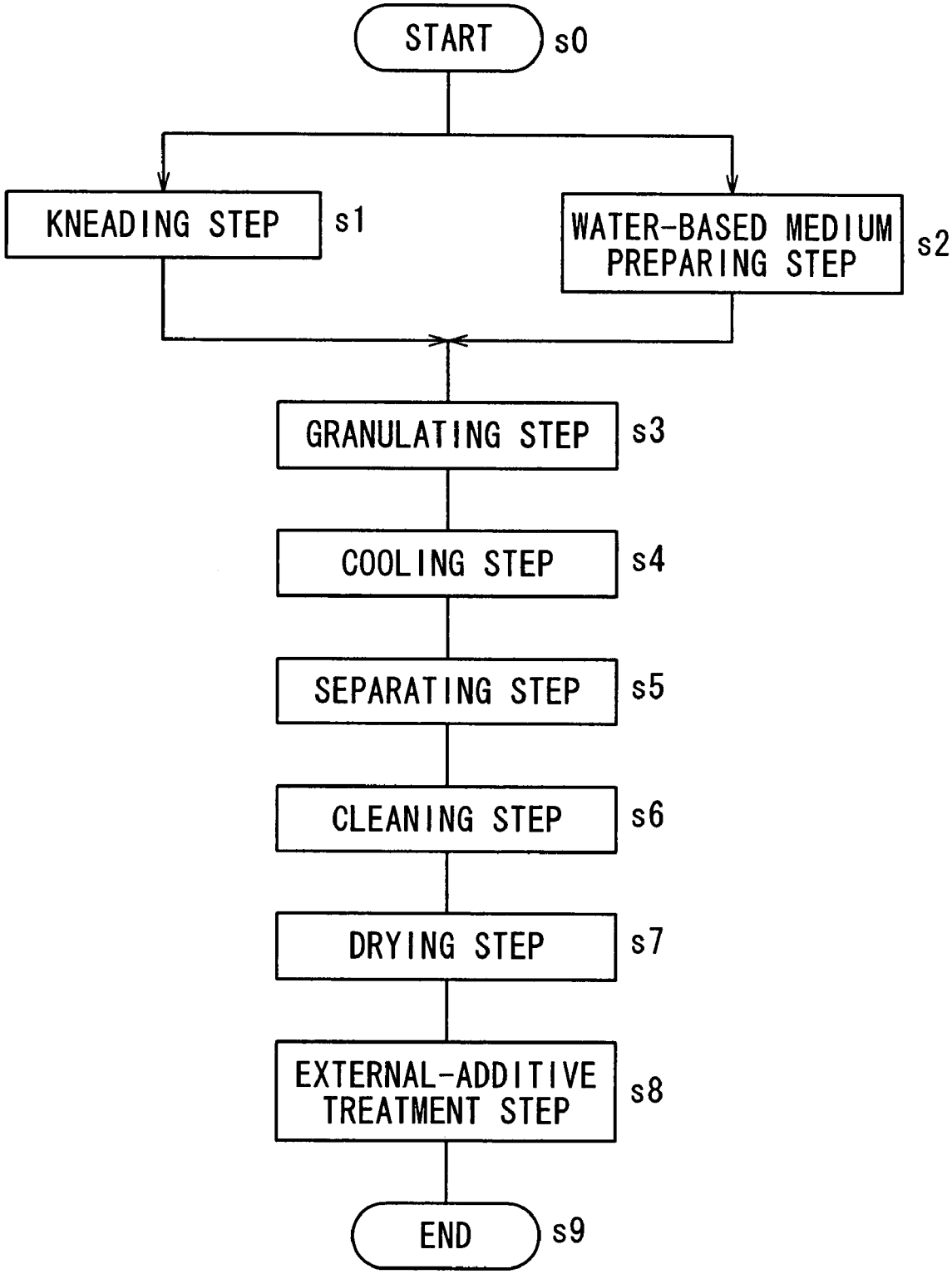
FIG. 1 is a flowchart showing a procedure of a method for manufacturing a toner according to one embodiment of the invention.

Now referring to the drawings, preferred embodiments of the invention are described below.

FIG. 1 is a flowchart showing a procedure of a method for manufacturing a toner according to one embodiment of the invention. The method for manufacturing a toner according to the embodiment includes, a kneading step (Step s1), a water-based medium preparing step (Step s2), a granulating step (Step s3), a cooling step (Step s4), a separating step (Step s5), a cleaning step (Step s6), a drying step (Step s7), and an external-additive treatment step (Step s8). The method for manufacturing a toner according to the embodiment is started at Step s0, and proceeded to Step s1 or Step s2. Either the kneading process of Step s1 or the water-based medium preparing step of Step s2 may be performed first. In addition, the cleaning step of Step s6 may be performed after the cooling step of Step s4 and before the separating step of Step s5.

[Kneading Step]

At the kneading step of Step s1, a toner composition containing at least a binder resin and a colorant is heated and melt-kneaded to produce a kneaded material. Accordingly, the kneaded material in which toner materials other than the binder resin are dispersed in the binder resin, in more detail, the kneaded material in which at least the colorant is dispersed in the binder resin, is obtained. The toner composition may include additive agents such as a charge control agent and a release agent, and the additive agents are kneaded with the colorant and the binder resin, and dispersed into the binder resin.

(a) Binder Resin

As the binder resin, the selection of resins is not particularly limited as long as the resins can be fused by heat. A softening temperature of the binder resin is not limited to a particular temperature, and may be selected as appropriate from a wide range. The softening temperature is preferably 150° C. or less, and more preferably from 60° C. to 150° C. When the softening temperature of the binder resin exceeds 150° C., the binder resin has a tendency to be less fused at the kneading step. Accordingly, it may possibly become difficult to knead the toner composition, thus decreasing dispersibility of the colorant and the additive agent in the kneaded material. In addition, when the toner is fixed on a recording medium, the toner has a tendency to be less fused or softened. Accordingly, a fixing property of the toner to the recording medium may be possibly decreased, thus causing a fixing failure. When the softening temperature of the binder resin is less than 60° C., storage stability of the toner is decreased, resulting that the toner has a tendency to cause thermal flocculation within an image forming apparatus. When the toner causes the thermal flocculation, the toner may not be stably supplied to an image bearing member, causing a development failure. Accordingly, the image forming apparatus may possibly induce malfunction.

A glass transition temperature (Tg) of the binder resin is not limited to a particular level and may be selected as appropriate from a wide range. Taking the fixing property and the storage stability of the toner obtained into account, the glass transition temperature (Tg) is preferably from 30° C. to 80° C. The glass transition temperature (Tg) of less than 30° C. may possibly result in the insufficient storage stability, thus causing the thermal flocculation of the toner to easily occur within the image forming apparatus. Accordingly, the development failure may possibly occur. In addition, a temperature (hereinafter referred to as a "high-temperature offset start temperature") at which a high-temperature offset phenomenon starts to occur is decreased. When the glass transition temperature (Tg) of the binder resin exceeds 80° C., the fixing property may be possibly decreased, causing the fixing failure. The "high-temperature offset phenomenon" is a phenomenon in which when a toner is fixed to a recording medium by heat and pressure using a fixing member such as a heating roller, the toner is overheated and then flocculation force of toner particles falls under adhesive force between the toner and the fixing member to divide a toner layer, and thereby a portion of the toner is attached to the fixing member to be removed.

A molecular weight of the binder resin is not limited to a particular level and may be selected as appropriate from a wide range. The molecular weight of the binder resin is preferably 5,000 or more and 500,000 or less in a weight-average molecular weight. When the weight-average molecular weight of the binder resin is less than 5,000, mechanical strength of the binder resin may be possibly decreased, resulting that the toner particles obtained may be easily pulverized by agitation or the like within a developing apparatus to change a shape of the toner particles produced at the granulating step. Accordingly, for example chargeability thereof may possibly have variations. When the weight-average molecular weight of the binder resin exceeds 500,000, the binder resin may possibly have a tendency to be less fused, resulting in difficulty in kneading with the colorant and the additive agent. Accordingly, the dispersibility of the colorant and the additive agent in the kneaded material may be possibly decreased. Moreover, the fixing property of the toner may be possibly decreased, resulting in the fixing failure. Here, the weight-average molecular weight of the binder resin is a value in polystyrene equivalent, which is measured by a gel permeation chromatography (abbreviated as a GPC).

As the binder resin, it is possible to use typical thermoplastic resins, and examples thereof include a polyester resin, a polyurethane resin, an epoxy resin, and an acrylic resin. These resins may be used alone or in combination. In addition, among the same resins, it is possible to use two or more resins different in any one, or two or more of the molecular weight and a monomer composition and the like, in combination.

Among the above-described resins, preferable is the polyester resin. The polyester resin has the softening temperature lower than that of other resins such as the acrylic resin, and thereby the use of the polyester resin provides a toner that can be fixed at a lower temperature, that is, the toner excellent in a low-temperature fixing property. Moreover, the polyester resin is excellent in translucency, and thereby the use of the polyester resin provides a color toner excellent in a coloring property, and excellent in the coloring property of a second color formed by superimposing a toner having another color.

As the polyester resin, the selection of ingredients is not particularly limited, and it is thus possible to use heretofore known ingredients, including a polycondensation of polybasic acids and polyhydric alcohols, for example. The "polybasic acids" mean a polybasic acid and a derivative thereof, for example acid anhydride of the polybasic acid or an esterified compound thereof. In addition, the "polyhydric alcohols" mean a compound having two or more hydroxyl groups, and include alcohols and phenols both.

As the polybasic acids, those commonly used as a monomer of the polyester resin can be used, including: aromatic carboxylic acids such as a terephthalic acid, an isophthalic acid, a phthalic acid anhydride, a trimellitic acid anhydride, a pyromellitic acid, and a naphthalene dicarboxylic acid; aliphatic carboxylic acids such as a maleic acid anhydride, a fumaric acid, a succinic acid, and an adipic acid. These polybasic acids may be used alone or in combination.

As the polyhydric alcohols, those commonly used as a monomer of the polyester resin can be used, including: aliphatic polyhydric alcohols such as ethylene glycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. "Bispnenol A" means 2,2-bis (p-hydroxyphenylacetic) propane. Examples of the ethylene oxide adduct of bispnenol A includes polyoxyethylene-2,2-bis (4-hydroxyphenylacetic) propane. Examples of the propylene oxide adduct of bisphenol A include polyoxypropylene-2,2-bis (4-hydroxyphenylacetic) propane. These polyhydric alcohols can be used alone or in combination.

The polyester resin can be produced by a polycondensation reaction. For example, the polyester resin can be produced by effecting the polycondensation reaction, specifically, a dehydration condensation reaction of the polybasic acids and the polyhydric alcohols each in the presence or absence of an organic solvent and under the presence of a polycondensation catalyst. At this time, a demethanol polycondensation reaction may be effected by applying a methyl-esterified compound of these polybasic acids to a portion of the polybasic acids. The polycondensation reaction of the polybasic acids and the polyhydric alcohols is terminated at the instant when an acid value and the softening temperature of the polyester resin stand at values of the polyester resin to be produced. In the polycondensation reaction, by properly changing reaction conditions such as a blending ratio, a reaction ratio as to the polybasic acid and the polyhydric alcohol, for example, by adjusting a terminal carboxyl group content of the resultant polyester resin, and thus the acid value of the resultant polyester resin, it is also possible to adjust other physical property values such as the softening temperature.

As the acrylic resin, the selection of ingredients is not particularly limited, and it is thus possible to use heretofore known ingredients, including homopolymers of acrylic monomers, and copolymers of the acrylic monomers and vinyl monomers, for example. Among these ingredients, preferable is the acrylic resin having an acid group. As the acrylic monomers, those commonly used as a monomer of the acrylic resin can be used, including: acrylic acid ester monomers such as acrylic acid, methacrylic acid, methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; methacrylic acid ester monomers such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate. As the acrylic monomers having a substituent group, examples thereof include acrylic acid ester monomers having a hydroxyl group such as hydroxyethyl acrylate, and hydroxypropyl methacrylate; or methacrylic acid ester monomers. The acrylic monomers can be used alone or in combination. As the vinyl monomers, it is possible to use heretofore known ingredients, including: aromatic vinyl monomers such as styrene, α-methylstyrene; aliphatic vinyl monomers such as vinyl bromide, vinyl chloride, and vinyl acetate; and acrylonitrile monomers such as acrylonitrile, and methacrylonitrile. The vinyl monomers can be used alone or in combination.

The acrylic resin can be manufactured, for example, by polymerization of one or two or more acrylic monomers, or by the polymerization of one or two or more acrylic monomers and one or two or more vinyl monomers, under the presence of a radical initiator, in accordance with a solution polymerization method, a suspension polymerization method, an emulsification polymerization method, or the like method. The acrylic resin having an acid group can be manufactured, for example, by the polymerization of acrylic monomers, or by the polymerization of acrylic monomers and vinyl monomers, by use of the acrylic monomers having an acid group or a hydrophilic group and/or the vinyl monomers having an acid group or a hydrophilic group.

As the polyurethane resin, the selection of ingredients is not particularly limited, and it is thus possible to use heretofore known ingredients, including an addition polymerization of polyols and polyisocyanates, for example. Among these ingredients, preferable is the polyurethane resin having an acid group or a hydrophilic group. The polyurethane resin having an acid group or a hydrophilic group can be produced, for example, by an addition polymerization reaction of the polyols having an acid group or a hydrophilic group, and the polyisocyanates. As the polyols having an acid group or a hydrophilic group, examples thereof include diols such as dimethylol propionic acid, and N-methyl diethanol amine; polyether polyols such as polyethylene glycol; and trivalent-plus polyols such as polyester polyols, acryl polyols, and polybutadiene polyols. The polyols can be used alone or in combination. As the polyisocyanates, examples thereof include tolylene diisocyanate, hexamethylene diisocyanate, and isophorone diisocyanate. The polyisocyanates can be used alone or in combination.

As the epoxy resin, the selection of ingredients is not particularly limited, and it is thus possible to use heretofore known ingredients, including a bisphenol A epoxy resin produced from bisphenol A and epichlorohydrin; a phenol novolac epoxy resin produced from phenol novolac as a reaction product of phenol and formaldehyde, and epichlorohydrin; and a cresol novolac epoxy resin produced from cresol novolac as a reaction product of cresol and formaldehyde, and epichlorohydrin. Among there resins, preferable is the epoxy resin having an acid group or a hydrophilic group. The epoxy resin having an acid group or a hydrophilic group can be manufactured, for example, by addition or addition polymerization of polyhydric carboxylic acids such as an adipic acid, and a trimellitic anhydride, or amines such as a dibutyl amine, and an ethylene diamine, to the above-described epoxy resin as a base.

(b) Colorant

The colorant includes dye and pigment. Among these colorants, preferable is the pigment. The pigment is excellent in light resistance and a coloring property, and thereby the use of the pigment provides a toner excellent in the light resistance and the coloring property. Examples of the colorant include the following colors of colorants. Hereinafter, a color index is abbreviated as a "C.I.".

A black colorant includes, for example, inorganic pigments such as carbon black, copper oxide, manganese dioxide, activated carbon, non-magnetic ferrite, and magnetic ferrite such as magnetite; and organic pigments such as aniline black.

An yellow colorant includes, for example, organic pigments such as C.I. pigment yellow 17, C.I. pigment yellow 74, C.I. pigment yellow 93, C.I. pigment yellow 155, C.I. pigment yellow 180, and C.I. pigment yellow 185.

An orange colorant includes, for example, organic pigments such as permanent orange GTR, pyrazolone orange, vulcan orange, indanthrene brilliant orange RK, benzidine orange G, indanthrene brilliant orange GK, C.I. pigment orange 31, and C.I. pigment orange 43.

A red colorant includes, for example, organic pigments such as C.I. pigment red 19, C.I. pigment red 48:3, C.I. pigment red 57:1, C.I. pigment red 122, C.I. pigment red 150, and C.I. pigment red 184.

A purple colorant includes, for example, inorganic pigments such as manganese purple; and organic pigments such as fast violet B, and methyl violet lake.

A blue colorant includes, for example, organic pigments such as C.I. pigment blue 15, C.I. pigment blue 15:2, C.I. pigment blue 15:3, C.I. pigment blue 16, and C.I. pigment blue 60.

A green colorant includes, for example, inorganic pigments such as malachite green lake; and organic pigments such as pigment green B, final yellow green G, and C.I. pigment green 7.

A white colorant includes, for example, inorganic pigments such as zinc white, titanium oxide, antimony white, and zinc sulfide.

These colorants can be used alone or two or more of the colorants of different colors may be used in combination. Further, two or more of the colorants with the same color may be used in combination. A usage of the colorant is not limited to a particular level, and can be selected as appropriate from a wide range, depending on various kinds of conditions such as types of the binder resin and the colorant, and properties suitable for toner particles intended to be manufactured. A typical usage of the colorant is preferably from 0.1 to 20 parts by weight, and more preferably from 5 to 15 parts by weight based on 100 parts by weight of the binder resin. When the usage of the colorant is less than 0.1 part by weight, a sufficient coloring strength may not be obtained. Accordingly, compared with a case in which the usage is not lower than 0.1 part by weight, an amount of a toner suitable to form an image having the same area as the above case, may be possibly increased, increasing a consumption of the toner. When the usage of the colorant exceeds 20 parts by weight, compared with a case in which the usage is 20 parts by weight or less, the dispersibility of the colorant in the kneaded material may be possibly decreased, preventing a toner having a certain level of the coloring strength from being obtained.

(c) Additive Agent

As the additive agent, examples thereof include a charge control agent and a release agent. The charge control agent is added to control a charge property of a toner. As the charge control agent, those commonly used in this field can be used, including: metal salts of a salicylic acid such as calixarenes, a quaternary ammonium salt compound, a nigrosine series compound, a metallo-organic complex, a chelate compound, and a zinc salicylic acid; and polymers produced by homopolymerization or copolymerization of monomers having an ionizable group such as a sulfonic acid group or a amino-acid group. The charge control agent can be used alone or in combination. The usage of the charge control agent is not limited to a particular level, and can be selected from a wide range, depending on various kinds of conditions such as a type and a content of other components such as the binder resin and the colorant, and properties suitable for a toner intended to be manufactured. The usage is preferably from 0.5 to 5 parts by weight based on 100 parts by weight of the binder resin.

Furthermore, by using the release agent as the additive agent, the release agent can be applied to a toner to allow the toner to fix to the recording medium, thus increasing the high-temperature offset start temperature and improving a high-temperature-resistant offset property, compared with a case in which the release agent is not used. In addition, heating for fixing a toner allows the release agent to fuse, and allows melt viscosity of the toner to decrease, thus allowing a temperature (hereinafter referred to as a "low-temperature offset start temperature"), at which a low-temperature offset phenomenon starts to occur, to decrease, and allowing a low-temperature-resistant offset property to improve. The "low-temperature offset phenomenon" is a phenomenon in which when a toner is fixed to the recording medium by heat and pressure using a fixing member such as a heating roller, the toner is not sufficiently heated or softened and then adhesive force between the toner and the recording medium falls under the adhesive force between the toner and the fixing member, and thereby a portion of the toner is attached to the fixing member to be removed.

A melting point of the release agent is preferably from 50° C. to 150° C. When the melting point is less than 50° C., the release agent may be possibly fused in the developing apparatus, causing mutual flocculation of toner particles or toner filming onto a photoreceptor surface. When the melting point exceeds 150° C., the release agent may not be sufficiently dissolved when the toner is fixed to the recording medium. Accordingly, an enhancing effect of the high-temperature-resistant offset property may not be sufficiently achieved. Therefore, the melting point of the release agent is more preferably 120° C. or less. At the granulating step in the invention, the kneaded material is heated in a water-based medium to be softened. At this time, not only the binder resin but the release agent in the kneaded material is softened or melted (hereinafter a "melting" is also referred to as a "fusing"). Accordingly, the release agent is desorbed from the toner particles depending on how the release agent is fused. To suppress desorption of the release agent, it is preferable that the melting point of the release agent is higher than the above-described granulating temperature. However, some kinds of the release agent impact on a releasing property of the toner, and thus the fixing property of the toner. Accordingly, the melting point of the release agent does not always have to be higher than the granulating temperature. Here, the melting point of the release agent is a heat absorption peak temperature corresponding to the melting on a DSC curve obtained by a differential scanning calorimetry (abbreviated as DSC) measurement.

As the release agent, it is possible to use ingredients which are commonly used in this field, including waxes, for example. As the waxes, examples thereof include natural waxes such as a carnauba wax, and a rice wax; synthesis waxes such as a polypropylene wax, a polyethylene wax, and a Fischer-Tropsch wax; carbonaceous waxes such as a montan wax; petroleum waxes such as a paraffin wax; alcoholic waxes; and ester series waxes. The release agent can be used alone or in combination. A usage of the release agent is not limited to a particular level and may be selected as appropriate from a wide range, depending on various kinds of conditions such as a type and a content of other components such as the binder resin and the colorant, and properties suitable for a toner intended to be manufactured. The usage of the release agent is preferably from 5 to 10 parts by weight based on 100 parts by weight of the binder resin. When the usage of the release agent is less than 5 parts by weight, an enhancing effect of the low-temperature fixing property and the high-temperature-resistant offset property may not be sufficiently achieved. When the usage of the release agent exceeds 10 parts by weight, the dispersibility of the release agent in the kneaded material may be possibly decreased, preventing a toner having a certain level of capabilities from being constantly obtained. In addition, a phenomenon called the toner filming, in which a toner is fusion-bonded onto a surface of the image bearing member such as a photoreceptor in a form of a film, may possibly occur.

In more detail, the toner composition containing the colorant and the binder resin is mixed by a blending machine, and then kneaded by a kneading machine in a state in which the binder resin is fused. For example, an appropriate amount of the binder resin and the colorant as described above, and an appropriate amount of the above-described additive agent such as the charge control agent and the release agent when needed, are dry-mixed by the blending machine, and then heated up to a temperature of at least the softening temperature of the binding resin and less than a decomposition temperature, specifically, around from 80° C. to 200° C., preferably around from 100° C. to 150° C., to fuse the binder resin. Accordingly, a resultant product is kneaded to obtain the kneaded material.

As the blending machine used for mixing the toner composition, it is possible to use heretofore known blending machines. Examples thereof include, Henschel-type mixers such as HENSCHEL MIXER (trade name, manufactured by Mitsui Kozan K. K.), SUPER MIXER (trade name, manufactured by Kawada Mfg. K. K.), MECHANOMILL (trade name, manufactured by Okada Seiko Co., Ltd.); ANGMILL (trade name, manufactured by Hosokawamicron Corporation), HYBRIDIZATION SYSTEM (trade name, manufactured by Nara Machinery Co., Ltd.); and COSMOSYSTEM (trade name, manufactured by Kawasaki Heavy Industries, Ltd.)

Examples of the kneading machine used for kneading the toner composition include, kneader/extruders such as a kneader, a rolling kneader, a one-axis kneader/extruder, and a two-axis kneader/extruder; and rolling mills such as a two-roll rolling mill, and a three-roll rolling mill. These kneading machines are commercially available, and examples thereof include MIRACLE K.C.K (trade name, manufactured by Asada Iron Works Co., Ltd.) such as KCK-L, KCK-26, KCK-32, KCK-42, KCK-52, KCK-62, KCK-72, KCK-82, and KCK-92 (these are all model numbers); TEM-100B (trade name, manufactured by Toshiba Machine Co., Ltd.), PCM-65/87 and PCM-30 (trade name, manufactured by Ikegai Co., Ltd.); and KNEADICS (trade name, manufactured by Mitsui Mining Co., Ltd.). The toner composition may be kneaded by using two or more kneading machines.

The toner composition may be directly put into the kneading machine without being mixed by the blending machine, and kneaded. However, as described in the embodiment, it is preferable that the toner composition is dry-mixed by the blending machine, and thereafter kneaded. Accordingly, the dispersibility of each component such as the colorant applied to the binder resin can be improved, thus securely providing a toner having a certain level of properties.

[Water-based Medium Preparing Step]

At the water-based medium preparing step of Step s2, a water-based medium to be mixed with the kneaded material at the granulating step of Step s3, is prepared. The water-based medium includes at least water. In the embodiment, as the water-based medium, the water-based medium (hereinafter referred to as a "disperser-containing water-based medium") containing water and a disperser is used.

In the disperser-containing water-based medium, the disperser may be in a state dissolved in water, or in a state dispersed in water. However, to achieve the effective granulation of the kneaded material at the granulating step of Step s3, the disperser is preferably in a state dissolved in water. Therefore, a substance capable of being dissolved in water is preferably used as the disperser. When a substance insoluble in water is used as the disperser, the disperser exists in its solid state in a mixture of the kneaded material and the disperser-containing water-based medium. Accordingly, the disperser serves as a boiling stone at the granulating step, thus causing tiny bubbles on a surface of the disperser. The bubbles may be possibly acted as an active spot to produce foam, thus making it difficult to generate a fluid flow of the mixture by agitation throughout a container. Accordingly, the kneaded material may be possibly prevented from being sheared, thus making the granulation of the kneaded material difficult. The use of the substance soluble in water as the disperser can prevent bubbles from being generated from the disperser at the granulating step, allowing the more effective granulation of the kneaded material. In addition, the substance soluble in water can be easily removed by a water washing or the like at the cleaning step of Step s6 as described later. Therefore, there are also advantages that the use of the substance soluble in water as the disperser can more securely prevent the disperser from remaining on toner particles and can improve uniformity of the charge property of a toner.

Examples of the disperser soluble in water include a water-soluble polymer and a surfactant. The "water-soluble polymer" is a compound having a molecular weight of 1,000 or more. Examples of the water-soluble polymer include styrene-vinylcarboxylic acid copolymers such as a styrene-acrylic acid copolymer, and a styrene-maleic acid copolymer; styrene-vinylcarboxylic acid copolymer salts such as a styrene-acrylic acid copolymer ammonium salt, and a styrene-α-styrene-acrylic acid copolymer ammonium salt; polyvinyl alcohol; polyvinyl pyrrolidone; and hydroxy cellulose. As the surfactant, any of a nonionic surfactant, an anionic surfactant, and a cationic surfactant can be used, and specific examples thereof include dodecyl sodium sulfate, sodium tetradecyl sulfate, sodium pentadecyl sulfate, sodium octyl sulfate, sodium oleate, sodium lauryl acid, potassium stearate, and calcium oleate. The dispersers can be used alone or in combination.

Among the dispersers soluble in water as described above, preferable is the water-soluble polymer, and more preferable is the styrene-vinylcarboxylic acid copolymer. When the surfactant is used as the disperser soluble in water, bubbles may be possibly generated in the disperser-containing water-based medium at the granulating step of Step s3, preventing the granulation of the kneaded material. The use of the water-soluble polymer as the disperser can prevent the bubbles found in a case of using the surfactant, and can allow the more effective granulation of the kneaded material at the granulating step of Step s3.

The weight-average molecular weight of the water-soluble polymer is preferably from 5,000 to 50,000, and more preferably, from 5,000 to 20,000. The use of the water-soluble polymer having the weight-average molecular weight of 5,000 to 50,000 as the disperser can improve the dispersibility of the kneaded material in the disperser-containing water-based medium, and can facilitate the granulation of the kneaded material. When the weight-average molecular weight of the water-soluble polymer is less than 5,000, unreacted monomers may remain in the water-soluble polymer, resulting that the water-soluble polymer may not act as the disperser sufficiently. When the weight-average molecular weight of the water-soluble polymer is more than 50,000, solubility thereof in water may be possibly decreased to increase viscosity of the disperser-containing water-based medium, preventing the granulation of the kneaded material. The weight-average molecular weight of the water-soluble polymer is a value in polystyrene equivalent, which is measured by the gel permeation chromatography (abbreviated as the GPC).

A content of the disperser in the disperser-containing water-soluble medium, that is, a concentration of the disperser is not limited to a particular level, and can be selected from a wide range as appropriate. Taking easiness of a mixing operation of the kneaded material and the disperser-containing water-soluble medium and dispersing stability of the produced toner particles into account, the concentration thereof is preferably from 5% to 40% by weight based on a total amount of the disperser-containing water-soluble medium having a temperature of 25° C. When the concentration of the disperser is less than 5% by weight, a ratio of the disperser to the kneaded material may not be preferable at the granulating step of Step s3 as described later to destabilize the dispersing stability of the toner particles in the disperser-containing water-soluble medium, thus causing flocculation, which may possibly make the granulation difficult. When the concentration of the disperser exceeds 40% by weight, the viscosity of the disperser-containing water-soluble medium may be possibly increased to prevent a fluid flow of the mixture by agitation, and a shearing action to the kneaded material, making the granulation of the kneaded material difficult.

For example, an appropriate amount of the above-described disperser is dissolved or dispersed into water to prepare the disperser-containing water-soluble medium. As water, it is preferable to use water having conductivity of 20 μS/cm or less. The conductivity of water depends on an amount of ionic components contained in water, and the less the conductivity is, the less the amount of the ionic components contained in water is. The ionic components contained in water may be possibly bonded to the disperser to prevent activity of the disperser, thus decreasing the dispersing stability of the kneaded material. The use of water having the conductivity of 20 μS/cm or less can prevent the disperser and the ionic components from bonding each other, and can allow the kneaded material to stably disperse into the disperser-containing water-soluble medium. Water having the conductivity of 20 μS/cm or less can be prepared, for example, in accordance with an activated carbon method, an ion-exchange method, a distillation method, or a reverse osmosis method. In addition, in the above-described methods, two or more methods may be combined to prepare water having the conductivity in the above-described range. Also, commonly available water purifying apparatuses such as MINIPURE TW-300RU (trade name, manufactured by Nomura Micro Science Co., Ltd.) can be used to prepare water.

[Granulating Step]

At the granulating step of Step s3, the kneaded material obtained at the kneading step of Step s1 is mixed with the water-based medium prepared at Step s2, and then a resultant mixture is heated to soften the kneaded material, and the resultant kneaded material is directly dispersed into the disperser-containing water-based medium to obtain toner particles. In more detail, the kneaded material is mixed with the disperser-containing water-based medium, and then the resultant mixture is heated and agitated to disperse the kneaded material softened in the water-based medium, to produce the toner particles. Here, a "softening" includes a "fusing".

The granulating temperature as a temperature of the water-based medium at the granulating step is adjusted to a temperature at which a loss tangent as a value G"/G' obtained by dividing a loss elastic modulus G" of the kneaded material by a storage elastic modulus G' reaches a predetermined setting loss tangent value A. The loss tangent of the kneaded material is vibrated and measured at a predetermined frequency (hereinafter also referred to as a "setting frequency"). In the embodiment, the setting loss tangent value A is 0.5 or more and less than 5.0, and the granulating temperature is selected to a temperature at which the loss tangent value of the kneaded material measured at the setting frequency of 0.1 Hz reaches the setting loss tangent value A of 0.5 or more and less than 5.0. In more detail, the granulating temperature is selected to a temperature at which the loss tangent value of the kneaded material measured at the setting frequency of 0.1 Hz reaches the setting loss tangent value A of 0.5 or more and less than 5.0, and the loss elastic modulus G" reaches a range from $10^3$ Pa to $10^5$ Pa.

Figure 2:
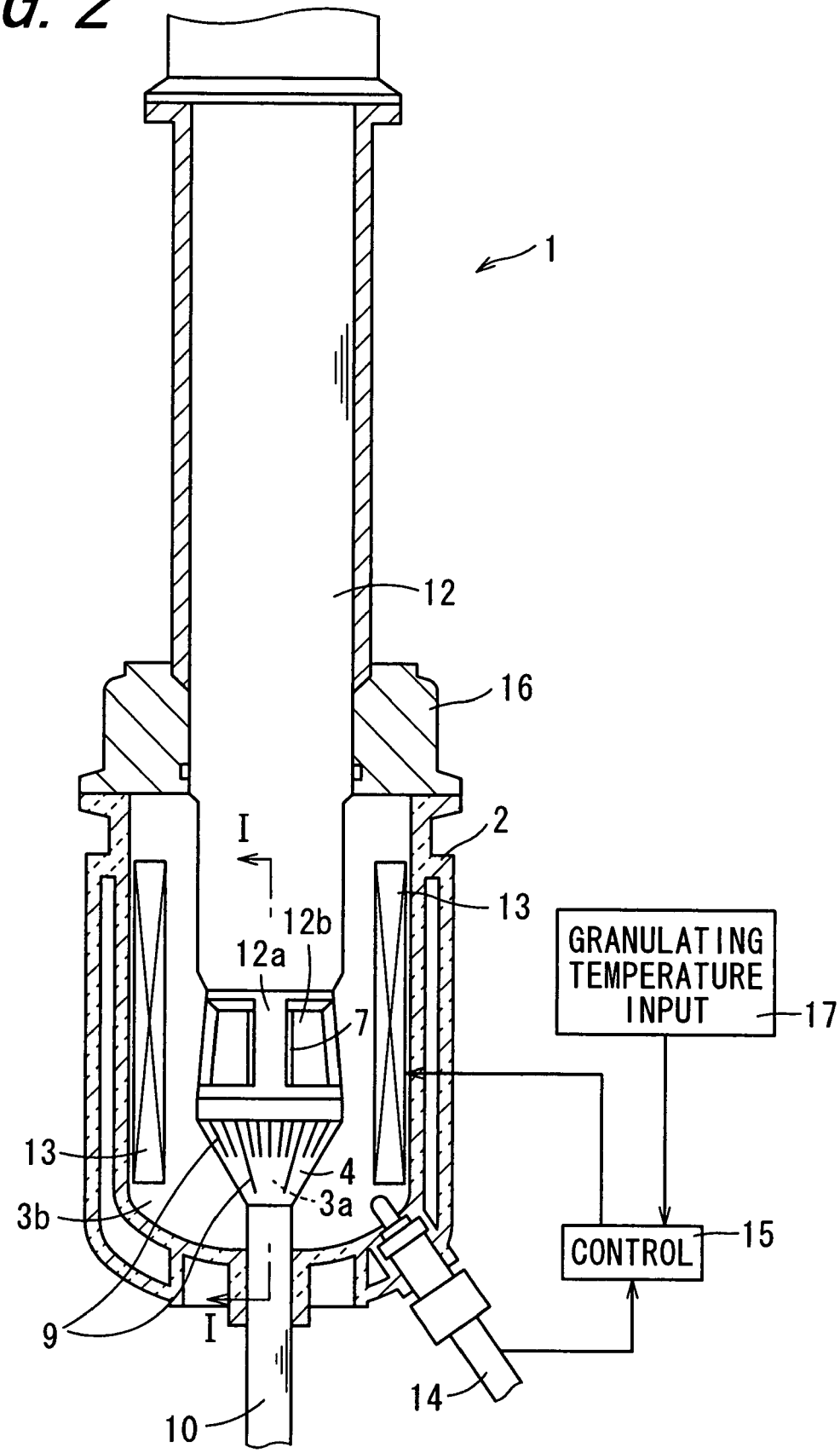
FIG. 2 is a partially sectional view schematically showing a configuration of a granulating apparatus as one example of the granulating apparatus used for the method for manufacturing a toner according to the embodiment.
Figure 3:
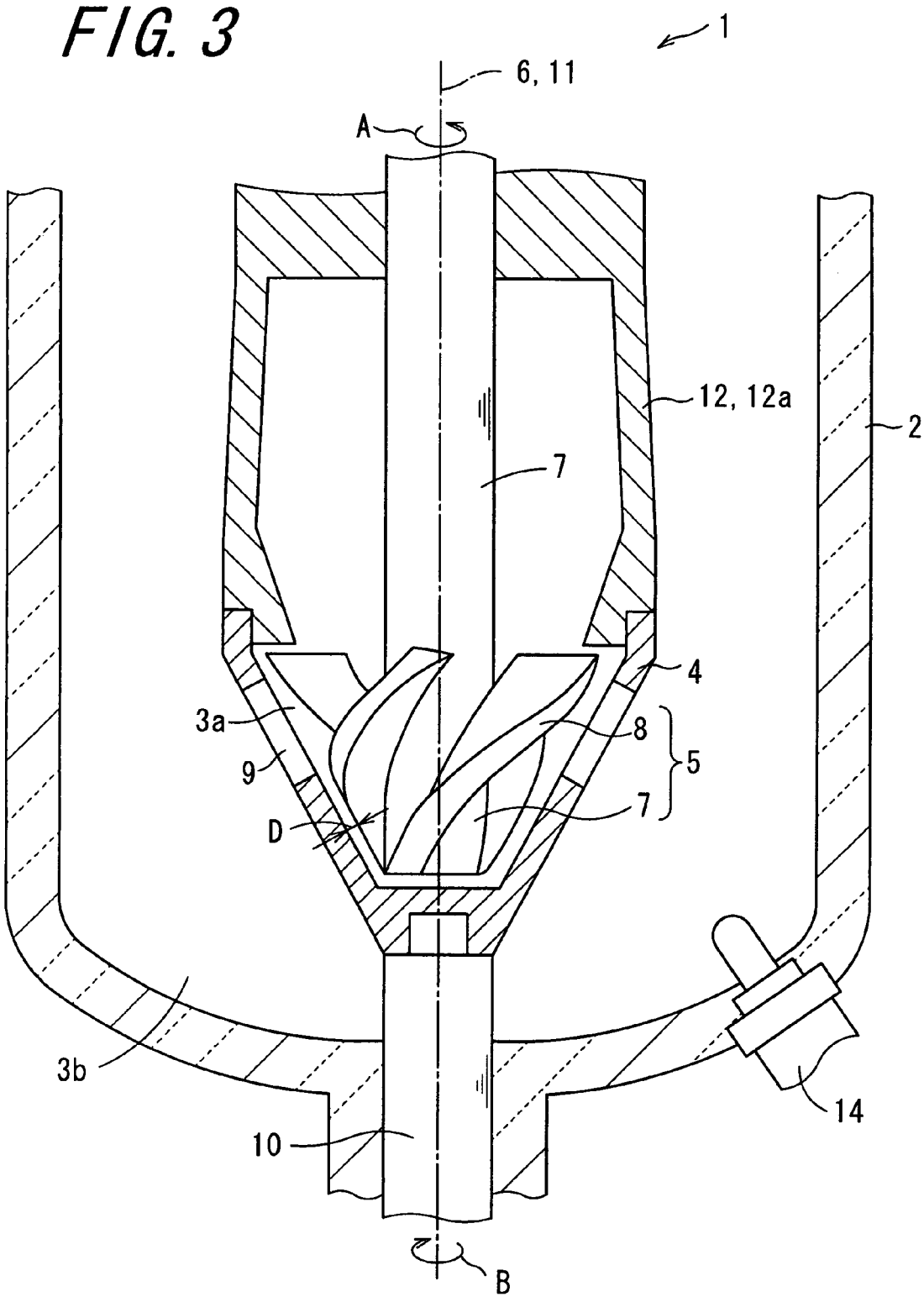
FIG. 3 is the partially sectional view, on an enlarged scale, showing an internal configuration of a screen of FIG. 2.

The granulating step is conducted by using a granulating apparatus 1 shown in FIGS. 2 and 3. FIG. 2 is a partially sectional view schematically showing a configuration of the granulating apparatus 1 as one example of the granulating apparatus used for a method for manufacturing a toner according to the embodiment. As shown in FIG. 2, a mixture discharging hole 9 is expressed in a line so as not to make the drawing complicated for a better understanding thereof. FIG. 3 is a partially sectional view, on an enlarged scale, showing an internal configuration of a screen shown in FIG. 2. FIG. 3 is the partially sectional view in a virtual plane taken on cross-sectional line I-I of FIG. 2. As shown in FIG. 3, a heater 13 of FIG. 2 is not shown so as not to make the drawing complicated for a better understanding thereof. In addition, FIG. 3 schematically shows a container 2 of FIG. 2. The granulating apparatus 1 of FIG. 2 is commercially available as a dispersing machine or an emulsifying machine. Examples thereof include CLEAMIX (trade name, manufactured by M. Technique Co., Ltd.).

When the granulating step is conducted using the granulating apparatus 1, first the kneaded material obtained at the kneading step of Step s1, and the disperser-containing water-based medium obtained at the water-based medium preparing step of Step s2, are put into the container 2. The kneaded material and the disperser-containing water-based medium are placed in an agitating space 3*a* and a space 3*b* out of the agitating space 3*a*, which are formed by a screen 4.

Next, the container 2 is hermetically sealed, and thereafter a rotating shaft member 7 of a rotor 5 is rotated and driven around a rotating axis line 6, for example, in a direction of an arrow A, and then a heating of the mixture by a heater 13 is started. In the embodiment, the screen 4 is not rotated and used as a stator. However, the screen 4 may be rotated by driving a rotating axis member 10 of the screen 4. For example, the screen 4 may be rotated around a rotating axis line 11 approximately parallel to the rotating axis line 6 of the rotor 5, in more detail, around the rotating axis line 11 approximately corresponding to the rotating axis line 6 of the rotor 5, in a direction of an arrow B opposite to a rotating direction of the rotating shaft member 7 of the rotator 5 shown by the arrow A.

In the agitating space 3*a*, a blade member 8 is rotated in association with a driving of the rotating shaft member 7 of the rotor 5, to rotate the whole of the rotor 5. Accordingly, the mixture is agitated. The kneaded material of the mixture is subjected to shear force when passing between the rotor 5 and the careen 4. Moreover, in the granulating apparatus 1 of FIG. 2, the mixture having kinetic energy obtained by being agitated in the agitating space 3*a* is intermittently discharged into the space 3*b* out of the agitating space 3*a*, through the mixture discharging hole 9 formed on a mixture discharging portion of the screen 4. Therefore, the shear force is produced between the mixture discharged from the mixture discharging hole 9 into the space 3*b* out of the agitating space 3*a* and the mixture remaining in the agitating space 3*a*.

The kneaded material in the disperser-containing water-based medium is heated with the disperser-containing water-based medium by the heater 13 to be softened. Accordingly, the softened kneaded material is fragmentated by the shear force produced when passing between the rotor 5 and the screen 4, and the shear force produced when being discharged from the mixture discharging hole of the screen 4, to be dispersed into the disperser-containing water-based medium. The mixture discharged into the space 3*b* out of the agitating space 3*a* is flown along an inner surface portion of the container 2, to be once again flown into the agitating space 3*a* through a mixture supplying hole 12*b* of a screen supporting body 13 and an inner space of a cylinder-shaped portion 12*a*. As described above, the mixture is circulated and repeatedly agitated in the container 2. Therefore, the kneaded material in the mixture is repeatedly subjected to the shear force to be dispersed into the disperser-containing water-based medium. Accordingly, the toner particles are produced in the disperser-containing water-based medium.

The kneaded material is fragmentated by the shear force or the like to produce the toner particles. Therefore, the toner particles that have just been fragmentated are nonspherical in most cases. For example, in the granulating apparatus 1 of FIG. 2, a distance D as the shortest distance between the blade member 8 of the rotor 5 and the screen 4 is narrow, for example, around 0.2 mm. In addition, the mixture discharging hole 9 is formed in a slit-shaped form. Therefore, the kneaded material is fragmentated in a form of an elongated stick to produce the toner particles.

The toner particles produced in the disperser-containing water-based medium is in its soften state, and are thus easily susceptible to plastic deformation. Susceptibility to plastic deformation of the toner particles depends on a viscoelastic character of the toner particles. The toner particles are a substance in which the kneaded material is dispersed in the disperser-containing water-based medium. Therefore, the viscoelastic character of the toner particles is equal to that of the kneaded material obtained at the kneading step. In addition, the viscoelastic character of the kneaded material obtained at the kneading step can be expressed by the loss tangent value. Therefore, the susceptibility to plastic deformation of the toner particles at the granulating step depends on the viscoelastic character of the kneaded material obtained at the kneading step, and can be expressed by the loss tangent value of the kneaded material obtained at the kneading step. In other words, the loss tangent value of the kneaded material obtained at the kneading step provides an indication of susceptibility to plastic deformation of the toner particles.

The loss tangent is a value G"/G' obtained by dividing the loss elastic modulus G" of the kneaded material by the storage elastic modulus G'. It is possible to consider that the loss elastic modulus G" represents viscosity of a sample, and the storage elastic modulus G' represents elasticity of the sample, and the loss tangent is a ratio of the loss elastic modulus G" of the sample, that is, a ratio of the viscosity to the elasticity. Therefore, in the kneaded material, the larger the loss tangent value thereof is, the higher the viscosity thereof is than the elasticity thereof, and thus the more susceptibility to the plastic deformation thereof is. Therefore, the loss tangent value at which the toner particles form an approximately spherical shape is defined as the setting loss tangent value A, and the granulating temperature is adjusted to a temperature at which the loss tangent value of the kneaded material reaches the setting loss tangent value A. Accordingly, a degree of plastic deformation of the toner particles obtained by dispersing the kneaded material into water can be adjusted to control a shape of the toner particles so as to have the approximately spherical shape. Therefore, it is possible to readily manufacture the toner particles having the approximately spherical shape.

The loss tangent value of the kneaded material depends on physical properties of the binder resin in the kneaded material. In addition, in the kneaded material, toner materials (hereinafter referred to as "dispersed materials") other than the binder resin, such as the colorant, are dispersed in the binder resin. Accordingly, the loss tangent value of the kneaded material depends on how the dispersed materials are dispersed in the binder resin, and the like. In other words, the loss tangent value of the kneaded material reflects the physical properties of the binder resin and the dispersed state of the dispersed materials in the kneaded material. Therefore, as described in the embodiment, the granulating temperature is set to a temperature at which the loss tangent value of the kneaded material reaches the setting loss tangent value A.

Accordingly, even when a toner is repeatedly manufactured using the same toner materials, and even when the kneaded material is changed as in the case in which a toner is manufactured using other toner materials, or the like cases, the toner particles having the approximately spherical shape can be readily and stably manufactured.

Furthermore, in the embodiment, the granulation is conducted at a temperature at which the setting loss tangent value A is 0.5 or more and less than 5.0, and the loss tangent value of the kneaded material measured at a frequency of 0.1 Hz is 0.5 or more and less than 5.0. Accordingly, the toner particles having the approximately spherical shape can be manufactured more securely. The expression, "the toner particles have the approximately spherical shape", means that an average spherical degree of the toner particles is 0.90 or more and 0.97 or less. A toner composed of the toner particles having the approximately spherical shape is used for an image forming by an electrophotographic method, or the like, to prevent poor cleaning of the toner remaining on an image bearing member such as a photoreceptor. Therefore, when the toner particles having the approximately spherical shape are used, it is possible to improve a cleaning property compared with a toner in which the toner particles have an average spherical degree of more than 0.97 and thus a shape similar to a true spherical shape, and it is possible to improve a flow property of the toner compared with a toner in which the toner particles have an average spherical degree of less than 0.90 and thus an irregular shape. Accordingly, the toner has a tendency to be charged by a frictional charge to allow the toner to be charged to a certain level of a charge amount, thus preventing an undesired scattering of the toner and fogging on an image. In addition, it is possible to stably supply the toner to the image bearing member, thus preventing a developing failure, further ensuring development of an electrostatic latent image formed on the image bearing member.

When the setting loss tangent value A is 5.0 or more, the toner particles have an undesired excessive susceptibility to plastic deformation. Therefore, the average spherical degree of the toner particles may possibly exceed 0.97, resulting that a shape of the toner particles becomes similar to the true spherical shape. As described above, when the average spherical degree of the toner particles exceeds 0.97 and a shape of the toner particles becomes similar to the true spherical shape, rolling friction force acting on the toner particles removed by cleaning members such as a cleaning blade is decreased, compared with a case of the toner particles having the approximately spherical shape. Therefore, the cleaning property of the toner may be possibly decreased, resulting in the poor cleaning. Moreover, when the setting loss tangent value A is less than 0.5, components having the viscosity in the toner particles may be possibly reduced, thus preventing plastic deformation of the toner particles. When the plastic deformation of the toner particles is prevented, a shape of the toner particles may be possibly maintained in a shape of when the toner particles have been produced by fragmentating the kneaded material. Accordingly, the average spherical degree of the toner particles may have a tendency to reach less than 0.90, resulting in the toner particles having a shape significantly out of the true spherical shape. As described above, when the toner particles have a shape significantly out of the true spherical shape, and the average spherical degree of less than 0.90, the flow property of the toner may be possibly decreased, causing its charge amount to fluctuate. Accordingly, the toner may be undesirably scattered to cause the fogging on an image. And accordingly, the toner may be possibly prevented from being supplied to the image bearing member, causing the developing failure. As described above, the setting loss tangent value A is set to 0.5 or more and less than 5.0 to achieve an appropriate plastic deformation of the toner particles, further ensuring the manufacturing of the toner particles having the approximately spherical shape.

The granulating temperature may be selected to be a temperature at which the loss tangent value of the kneaded material reaches the setting loss tangent value A. However, as described in the embodiment, the granulating temperature is more preferably selected considering the loss elastic modulus G" of the kneaded material as well. In more detail, the granulating temperature is preferably selected to be a temperature at which the loss elastic modulus G" of the kneaded material measured at a frequency of 0.1 HZ reaches a range from $10^3$ Pa to $10^5$ Pa.

When the granulating temperature is selected to be a temperature at which the loss elastic modulus G" of the kneaded material is more than $10^5$ Pa, the kneaded material has a tendency to be less softened at the granulating step, increasing force suitable for the granulation, such as the shear force. Specifically, it is necessary to increase driving torque of the granulating apparatus used at the granulating step. That is, significant energy is necessary. In addition, it may possibly become difficult to granulate the toner particles. Furthermore, when the granulating temperature is selected to be a temperature at which the loss elastic modulus G" of the kneaded material is less than $10^3$ Pa, the kneaded material is too much softened at the granulating step. Accordingly, the dispersed materials such as the colorant dispersed in the binder resin may be possibly flocculated, decreasing the dispersibility, or the dispersed materials may be possibly desorbed from the binder resin into the disperser-containing water-based medium, to change a ratio of the toner materials in the toner particles and a ratio of the toner materials in the kneaded material.

On the other hand, as described above, the granulating temperature is selected to be a temperature at which the loss elastic modulus G" of the kneaded material measured at a frequency of 0.1 HZ reaches a range from $10^3$ Pa to $10^5$ Pa, further facilitating granulation of the toner particles and the manufacturing of the toner particles having the approximately spherical shape. In addition, energy suitable for the granulation can be decreased, preventing an increase in the driving torque of the granulating apparatus used at the granulating step. Furthermore, the dispersed materials such as the colorant can be prevented from being flocculated in the binder resin and from being desorbed from the binder resin, thus allowing the more stable manufacturing of the toner having a certain level of properties.

Furthermore, when the toner composition contains the release agent, and the release agent is contained in the kneaded material, the granulating temperature is preferably a temperature that meets the above-described condition and is lower than the melting point of the release agent. When the granulating temperature is not lower than the melting point of the release agent, the release agent may be possibly desorbed from the binder resin at the granulating step to produce an insufficient enhancing effect of the high-temperature-resistant offset property and the low-temperature-resistant offset property by the release agent, resulting that a temperature range that allows a fixing without causing the offset phenomenon may be possibly narrowed. In addition, the release agent desorbed at the granulating step may be possibly attached to a surface of the toner particles produced, and then fuse-bonded to the image bearing member to cause the toner filming. As described above, the granulating temperature is set to a temperature lower than the melting point of the release agent, thus preventing the release agent from being desorbed from the binder resin, or decreasing a desorbed amount of the release agent from the binder resin at the granulating step. Therefore, the temperature range that allows the fixing without causing the offset phenomenon can be prevented from being narrowed. In addition, the toner filming caused by attachment of the release agent desorbed to the toner particles can be prevented.

Figure 4:
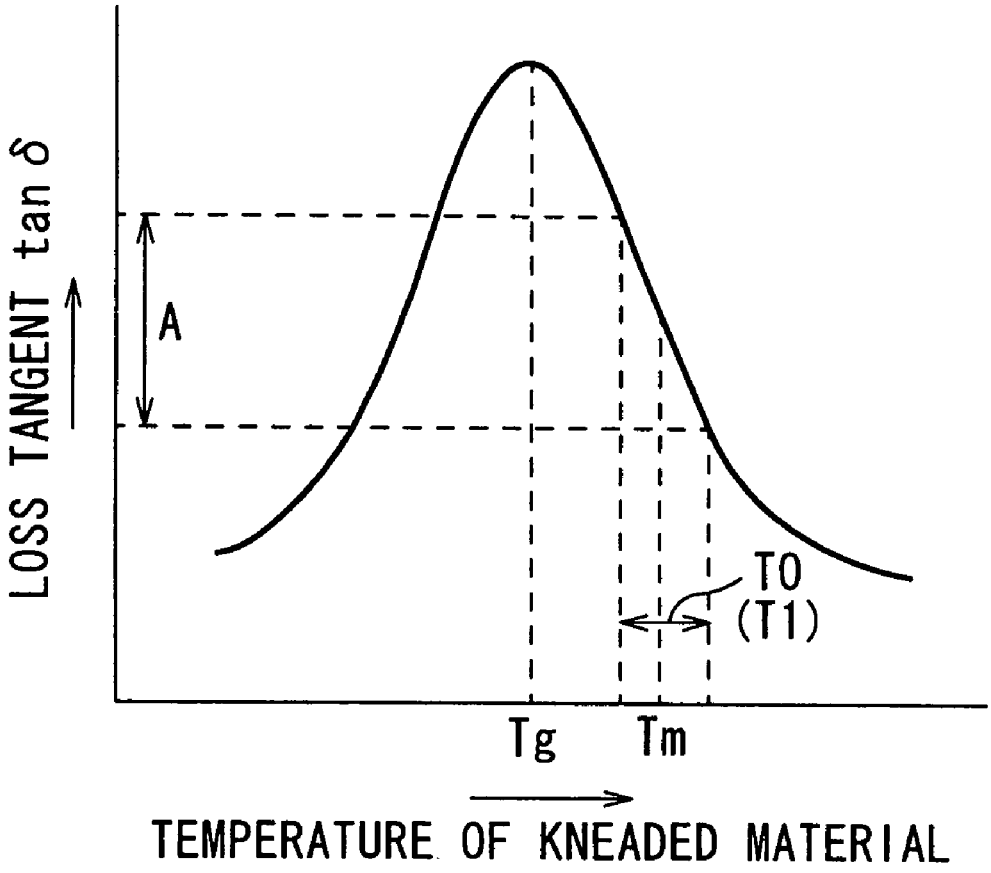
FIG. 4 is a view schematically showing a loss tangent-temperature characteristic curve.

The setting loss tangent value A defining the granulating temperature is determined, for example, according to the following. First, the kneaded material is produced from the toner materials, and the resultant kneaded material is measured while changing a temperature, with respect to the loss tangent of the kneaded material, to obtain a loss tangent-temperature characteristic curve representing a relationship between the loss tangent and the temperature. FIG. 4 is a view schematically showing the loss tangent-temperature characteristic curve.

Next, using the kneaded material used for measuring the loss tangent, a temperature of the water-based medium at the granulating step, for example, a temperature measured by using a thermometer 14 of the granulating apparatus 1 of FIG. 2 is changed to various values, to produce the toner particles. A shape of the toner particles produced at each temperature is examined to obtain a temperature range T0 of the water-based medium when the toner particles having an objective shape is obtained. A shape of the toner particles can be examined, for example, by the average spherical degree. In the embodiment, to produce the toner particles having the approximately spherical shape, the temperature range T0 in which the average spherical degree reaches 0.90 or more and 0.97 or less is obtained. The loss tangent value of the kneaded material in the obtained temperature range T0 is obtained from the previously measured loss tangent-temperature characteristic curve. This value is taken as the setting loss tangent value A of when the toner particles having an objective shape is obtained. In a case of the toner particles having the approximately spherical shape, the setting loss tangent value A obtained by doing as described above is 0.5 or more and less than 5.0.

The granulating temperature is set based on the setting loss tangent value A determined by doing as described above. In more detail, the kneaded material obtained at the kneading step is measured at each temperature with respect to the loss tangent to obtain the loss tangent-temperature characteristic curve of FIG. 4. A temperature at which the loss tangent value of the kneaded material reaches the setting loss tangent value A is obtained from the obtained loss tangent-temperature characteristic curve. This temperature is taken as a setting granulating temperature T1 of the water-based medium to be reached.

A temperature of the kneaded material at the granulating step is approximately equal to a temperature of the water-based medium in which the kneaded material is dispersed, that is, the granulating temperature. For example, when the granulating apparatus 1 of FIG. 2 is used, the temperature of the kneaded material is approximately equal to the temperature of the water-based medium measured by using the thermometer 14. When the setting granulating temperature T1 is inputted to a granulating temperature input section 17, the setting granulating temperature T1 is outputted to a control section 15. The control section 15 controls operation of the heater 13 so that the temperature of the water-based medium measured by the thermometer 14 reaches the setting granulating temperature T1 based on a temperature inputted from the thermometer 14. Accordingly, the control section 15 adjusts the temperature of the kneaded material to the setting granulating temperature T1.

In the embodiment, corresponding to the granulating apparatus 1 of FIG. 2 as described above, there is used a granulating apparatus having the control section 15 for adjusting the temperature of the kneaded material to the setting granulating temperature T1. The granulating apparatus may be a batch-type granulating apparatus in which a predetermined amount of the kneaded material and the water-based medium are inputted and the water-based medium containing the produced toner particles is discharged after every granulating process, or may be a continuous granulating apparatus in which the kneaded material and the water-based medium are sequentially inputted and the water-based medium containing the produced toner particles is sequentially discharged.

The granulating apparatus 1 of FIG. 2 is commercially available as a dispersing machine or an emulsifying machine. Examples thereof include, but are not limited to, CLEAMIX (trade name, manufactured by M. Technique Co., Ltd.). Other apparatuses commercially available as the dispersing machine or the emulsifying machine may be used. Examples thereof include batch type emulsifying machines such as ULTRA TURRAX (trade name, manufactured by IKA Japan Co., Ltd.), POLYTRON HOMOGENIZER (trade name, manufactured by Kinematica), and TK AUTOHOMO-MIXER (trade name, manufactured by Tokushu Kika Kogyo Co., Ltd.); and continuous type emulsifying machines such as EBARA MILDER (trade name, manufactured by Ebara Corp.), T.K. PIPELINE HOMO-MIXER, T.K. HOMOMIC LINE FLOW, T.K. FILMIX (trade name, manufactured by Tokushu Kika Kogyo Co., Ltd.), COLLOID MILL (trade name, manufactured by Shinko Pantec Co., Ltd.), SLASHER, TRIGONAL WET FINE PULVERIZER (trade name, manufactured by Mitsui-Miike Kakoki Co., Ltd.), CAVITRON (trade name, manufactured by EUROTEC, LTD.), and FINE FLOW MILL (trade name, manufactured by Pacific Machinery & Engineering Co., Ltd.). CLEAMIX and T.K. FILMIX as described above can be used as the dispersing machine and the emulsifying machine both.

In the granulating apparatus 1 of FIG. 2, the heater as a heating section is achieved, for example, by a coil wound around the rotating shaft member 7 of the rotor 5 in one direction of a rotating direction of the rotating shaft member 7. The heating section such as the heater 13 is preferably provided along an inner surface portion of the container 2 as shown in FIG. 2, in more detail, along a side wall portion. The mixture of the kneaded material and the water-based medium is circulated along the inner surface portion of the container 2 by rotation of the rotor 5. Therefore, the heating section such as the heater 13 is provided along the inner surface of the container 2 to more uniformly heat the mixture of the water-based medium and the kneaded material. Therefore, it is possible to adjust the temperature of the water-based medium in the container 2, and thus the temperature of the kneaded material, throughout the mixture, to the setting granulating temperature T1, further ensuring the manufacturing of the toner particles having the approximately spherical shape.

When the granulating apparatus comprising the rotor 5 as an agitating section, corresponding to the granulating apparatus 1 of FIG. 2, an agitating speed of the mixture of the kneaded material and the disperser-containing water-based medium, that is, a rotating speed of the rotor 5 can be selected as appropriate so that an agitating operation can be readily conducted and the kneaded material is immediately granulated, in accordance with a type and a content of the dispersed materials in the kneaded material such as the binder resin and the colorant, a type and a concentration of the disperser in the disperser-containing water-based medium, a usage of the kneaded material and the disperser-containing water-based medium, and the like.

An agitating period of the mixture of the kneaded material and the water-based medium is not limited to a particular level, and may be selected as appropriate in accordance with various kinds of conditions such as the agitating speed, a type and a content of the dispersed materials in the kneaded material such as the binder resin and the colorant, a type and a concentration of the disperser in the disperser-containing water-based medium, a particle diameter of the toner particles to be manufactured, and the granulating temperature.

In the embodiment, the mixture is agitated and heated in a pressurized state in a container containing the mixture of the kneaded material and the water-based medium, for example, the container 2 of FIG. 2. The container does not always have to be in the pressurized state. The mixture is heated and agitated in the pressurized state in the container to increase a boiling point of water contained in the disperser-containing water-based medium. Accordingly, the disperser-containing water-based medium can be heated up to a temperature of 100° C. or more without bringing the disperser-containing water-based medium to a boil. Therefore, a decrease in the shear force due to bobbles can be prevented, allowing the more effective granulation of the kneaded material.

Pressure in the container is not limited to a particular level, and may be selected as appropriate so that an agitating operation can be readily conducted and the kneaded material is readily granulated, in accordance with various kinds of conditions such as a type and a content of the dispersed materials in the kneaded material such as the binder resin and the colorant, a type and a concentration of the disperser in the disperser-containing water-based medium, a usage of the kneaded material and the disperser-containing water-based medium, and the granulating temperature. The pressure in the container is, for example, 0.1 MPa (about 1 atm) or more and 1 MPa (about 10 atm) or less. The "pressurized state" means a state in which the pressure is higher than the atmospheric pressure.

When the pressure in the container becomes too high, bubbles produced in the disperser-containing water-based medium may not be possibly disappeared, and transformed to fine bobbles to be sealed in a system by pressure, thus preventing the granulation of the kneaded material. Therefore, the pressure in the container is preferably a minimum pressure that can prevent a boiling of the disperser-containing water-based medium at the granulating temperature. Therefore, the pressure in the container is selected particularly considering the granulating temperature. For example, when the granulating temperature is 120° C., the pressure in the container is around 0.2 MPa (about 2 atm).

As the kneaded material, the kneaded material in its molten state or its softened state, obtained by kneading the toner composition containing at least the binder resin and the colorant, may be directly used, or a solidified material obtained by kneading and then cooling the toner composition may be directly used, or may be used after once again heating the solidified material to return to its molten state or its softened state.

A usage of the disperser-containing water-based medium is preferably selected, depending on a concentration of the disperser, so that an amount of the disperser reaches from 5 parts by weight to 200 parts by weight based on 100 parts by weight of the kneaded material. When the usage of the disperser is less than 5 parts by weight, an effect to prevent coarsening the toner particles to be produced may not be sufficiently achieved, thus increasing a particle diameter and a width of a particle size distribution of the toner particles obtained. When the usage of the disperser is more than 200 parts by weight, viscosity of the disperser-containing water-based medium may possibly become too high to stably disperse the toner particles obtained into the disperser-containing water-based medium.

Furthermore, a mixing ratio of the disperser-containing water-based medium to the kneaded material is preferably a ratio of from 100 parts by weight to 2,000 parts by weight of the disperser-containing water-based medium based on 100 parts by weight of the kneaded material. The mixing ratio of the disperser-containing water-based medium to the kneaded material is set to a ratio of from 100 parts by weight to 2,000 parts by weight of the disperser-containing water-based medium based on 100 parts by weight of the kneaded material, thus facilitating a mixing operation of the kneaded material and the disperser-containing water-based medium, a separating operation of the toner particles at the separating step of Step s5 as described later, and a cleaning operation of the toner particles at the cleaning step of Step s6. When a ratio of the disperser-containing water-based medium is less than 100 parts by weight based on 100 parts by weight of the kneaded material, the viscosity of the mixture may possibly become too high to apply the shear force produced by agitation to the kneaded material, thus making the granulation of the kneaded material difficult. When the ratio of the disperser-containing water-based medium is more than 2,000 parts by weight based on 100 parts by weight of the kneaded material, the mixing operation of the kneaded material and the disperser-containing water-based medium, and the like may be possibly complicated to decrease productivity.

The concentration of the disperser in the disperser-containing water-based medium is preferably determined so as to meet a preferable usage ratio of the disperser and a preferable mixing ratio of the disperser-containing water-based medium, based on the above-described kneaded material.

As described above, the kneaded material in its softened state is dispersed into the disperser-containing water-based medium to produce the toner particles. In the embodiment, the toner particles produced at the granulating step have an additive agent added at the external-additive treatment step of Step s8 as described later, to produce the toner particles constituting a toner. Though not equal to the embodiment, when the external-additive treatment step cannot be disposed, the toner articles produced at the granulating step are regarded as the toner particles. As described above, in the invention, the "toner particles" include toner particles having the external additive agent added. In addition, the "toner" means an aggregate of the toner particles.

[Cooling Step]

At the cooling step of Step s4, the water-based medium (hereinafter also referred to as a water-based slurry), in which the toner particles produced are dispersed, is cooled. The water-based slurry is cooled in such a manner that, for example, the toner particles are produced at the granulating step of Step s3, and then heating by the heating section of the granulating apparatus is stopped to conduct a forced cooling that a material is cooled by force using a cooling medium, or a natural cooling that a material is left untouched to cool.

At the granulating step, the kneaded material is heated in the water-based medium to be softened, and directly transformed into particles. Therefore, the toner particles just after produced are in its softened state, and carry an adhesive property. In such a state, the toner particles may be mutually fusion-bonded to produce coarse particles. In the embodiment, the disperser is contained in the water-based medium to stabilize the toner particles, thus keeping a state in which the toner particles are dispersed in the water-based medium. Therefore, at the cooling step, the toner particles are not transformed into the coarse particles. Accordingly, the toner particles can be cooled while keeping its shape and its size of when produced at the granulating step. Accordingly, in the embodiment, the toner particles can be cooled while preventing formation of coarse particles and a change in shape. It is thus possible to more securely obtain the toner having a certain level of shape.

The mixture (the water-based slurry) is preferably cooled while being agitated. When the mixture is cooled without being agitated, in a case in which a temperature of the water-based medium is not lower than a softening temperature of the binder resin contained in the toner particles, a dispersion stabilizing effect of the toner particles by the disperser may not be sufficiently achieved, resulting that the toner particles are mutually fusion-bonded to produce the coarse particles. Therefore, the mixture (the water-based slurry) is preferably continued to be agitated at the cooling step as well.

Furthermore, when the kneaded material is granulated under pressure at the granulating temperature of 100° C. or more, the application of the pressure is preferably continued at the cooling step as well. In a case in which the water-based medium has a temperature of 100° C. or more, when the application of the pressure is stopped to return the pressure in the container to the atmospheric pressure, the water-based medium boils and thus produces considerable bobbles, making a cleaning operation at the cleaning step and a separating operation at the separating step, as described later, difficult. The pressure in the container is returned to the atmospheric pressure, preferably when a temperature of the water-based medium in the container is reduced to 50° C. or less, and more preferably when the water-based medium in the container is cooled to a room temperature.

[Separating Step]

At the separating step of Step s5, the toner particles are separated from the water-based medium that has been cooled. The toner particles can be separated from the water-based medium, for example, by filtration, suction filtration, centrifugal separation, or the like.

[Cleaning Step]

At the cleaning step of Step s6, the toner particles separated from the water-based medium is cleaned to remove the disperser and impurities originating from the disperser. When the disperser and the impurities remains on the toner particles, the chargeability of the toner to be obtained may possibly become uneven. In addition, the disperser and the impurities may possibly absorb moisture in the air, resulting that the charge amount of the toner may be changed depending on ambient humidity.

The toner can be cleaned, for example, by washing the toner particles separated in water. It is preferable that the toner particles are repeatedly washed in water, until conductivity of washing water that has been used for washing the toner particles reaches 100 μS/cm or less, preferably, 10 μS/cm or less, for example, by measuring with a conductivity meter. Accordingly, the disperser and the impurities are more securely prevented from remaining, thus achieving further uniformity in the chargeability of the toner.

Water to be used for washing the toner particles preferably has the conductivity of 20 μS/cm or less. Accordingly, ionic components contained in water are prevented from remaining on the toner particles, thus achieving further uniformity in the chargeability of the toner. Water having the chargeability of 20 μS/cm or less can be prepared, for example, in accordance with an activated carbon method, an ion exchange method, a distillation method, or a reverse osmosis method. Further, among the above-described methods, two or more methods may be combined to prepare water having the conductivity in the above-described range. The toner particles may be washed in water by both a butch type and a continuous type. Further, a temperature of water to be used for washing is not limited to a particular temperature, but is, preferably, from 10° C. to 80° C. The use of the water having a temperature of from 10° C. to 80° C. for washing the toner particles further ensures removal of the disperser and the impurities.

Though not equal to the embodiment, when the cleaning step of Step s6 is disposed between the cooling step of Step s4 and the separating step of Step s5, the toner can be cleaned, for example, by adding water to the mixture that has been cooled and then agitating the mixture. It is preferable that the toner particles are repeatedly washed in water, until the conductivity of a supernatant solution separated from the mixture by centrifugal separation or the like reaches 100 μS/cm or less, preferably, 10 μS/cm or less, for example, by measuring with the conductivity meter. Accordingly, the disperser and the impurities are more securely prevented from remaining, achieving further uniformity in the chargeability of the toner.

[Drying Step]

At the drying step of Step s7, the toner particles that have been cleaned are dried. The toner is dried, for example, by a freeze-drying method, a flush drying method, or the like method.

The toner particles that have been dried can be directly used as the toner particles. However, in the embodiment, the external-additive agent is added at the external-additive treatment of Step s8.

[External-additive Treatment Step]

At the external-additive treatment step of Step s8, the external-additive agent is added to the dried toner particles to produce the toner particles. The external-additive agent may be attached to a surface of the toner particles, or may be partially or totally embedded in the surface of the toner particles. As the external-additive agent, examples thereof include a flow improver. The flow improver is externally added to the toner particles to improve particle flowability of the toner. As the flow improver, the same ingredients as the flow improver to be internally added to the toner particles can be used, and examples thereof include metal oxide particles such as silica, and titanic oxide; and metal oxide particles treated with surface modification such as a hydrophobizing treatment by a surface modifying agent such as a silane coupling agent.

A use ratio of the external-additive agent to the toner particles is not limited to a particular level, but is preferably from 0.1 parts by weight to 10 parts by weight based on 100 parts by weight of the toner particles. When the use ratio of the external-additive agent is less than 0.1 parts by weight based on 100 parts by weight of the toner particles, a flowability enhancing effect may not be sufficiently achieved. When the use ratio of the external-additive agent is more than 10 parts by weight based on 100 parts by weight of the toner particles, the external-additive agent may exit in its released state in the toner, and the released external-additive agent may damage the image bearing member such as the photoreceptor to cause an image defect. In the embodiment, particles of the flow improver are used as particles of the internal-additive agent to expose the flow improver onto a surface of the toner particles, thus reducing an amount of the flow improver to be externally added to the toner particles, which more securely prevents damage to the image bearing member.

As described above, the toner composed of the toner particles is obtained. When the toner is produced in accordance with the above-described steps, a toner manufacturing according to the embodiment is finished at Step s9. According to a method for manufacturing a toner in the embodiment, at the granulating step, the granulating temperature as a temperature of the water-based medium is adjusted to a temperature at which the loss tangent value of the kneaded material obtained at the kneading step of Step s1 reaches the setting loss tangent value A. In more detail, the granulating temperature as a temperature of the water-based medium at the granulating step, and thus a temperature of the kneaded material at the granulating step is adjusted to a temperature at which the loss tangent value of the kneaded material vibrated and measured at the setting frequency of 0.1 Hz reaches the setting loss tangent value A of 0.5 or more and less than 5.0. Therefore, the toner particles having the approximately spherical shape can be readily manufactured. Accordingly, it is possible to obtain the toner excellent in the cleaning property and the flowability. The use of the above-described toner can prevent the poor cleaning. Accordingly, the toner can be charged to a certain level of a charge amount, thus preventing an undesired scattering of the toner and fogging on an image. In addition, it is possible to stably supply the toner to the image bearing member, thus preventing a developing failure to further ensure development of an electrostatic latent image formed on the image bearing member. Therefore, a decrease in image density, occurrence of image fogging, and a decrease in a transfer property can be prevented.

Furthermore, according to a method for manufacturing a toner, the kneaded material is dispersed in its softened state into the water-based medium to produce particles. Therefore, compared with a pulverizing method in which the kneaded material is pulverized in its solid state to produce particles, the toner having the narrower particle size distribution and excellent in uniformity in a particle diameter can be obtained. Therefore, since classification is not necessary unlike the pulverizing method, manufacturing steps can be simplified. In addition, according to a method for manufacturing a toner, it is possible to more readily produce the smaller toner particles having a volume average particle diameter of, for example, 10 μm or less, compared with the pulverizing method.

Further, in the embodiment, at the granulating step, the mixture of the kneaded material and the water-based medium is heated and agitated to be softened and dispersed into the water-based medium. There is no particular limitation to the binder resin, as long as resins capable of being fused or softened by heat is used. Therefore, a toner can be manufactured by using resins other than resins capable of being prepared by radical polymerization, for example, a polyester resin. Unlike a polymerization method, a toner can be manufactured without using a monomer of the binder resin, thus preventing the monomer of the binder resin from remaining in the toner. In addition, the toner particles can be produced without using an organic solvent, thus preventing the organic solvent from remaining in the toner. As described above, it is possible to prevent the monomer of the binder rein and the organic solvent from remaining in the toner, more securely preventing variations of the chargeability of the toner. In addition, it is possible to discharge no waste solution containing the organic solvent, or to reduce an amount of the waste solution, thus reducing costs for disposing of the waste solution.

A toner obtained by a method for manufacturing a toner according to the embodiment, can be used for development of an electrostatic latent image when an image is formed by an electrophotographic method or a electrostatic recording method, or development of a magnetic latent image when an image is formed by a magnetic recording method. The toner manufactured according to the embodiment can be used as a one-component developer or a two-component developer.

EXAMPLES

Hereinafter, the invention will be described specifically with reference to examples and comparative examples, but the invention is not limited by these examples in any way.

[Physical Property Measurement Method]

[Peak-Top Molecular Weight and Molecular Weight Distribution Exponent (Mw/Mn) of Binder Resin]

A peak-top molecular weight and a molecular weight distribution exponent (Mw/Mn) were measured according to the following. A molecular weight distribution curve was obtained by using a GPC apparatus (trade name: HLC-8220GPC, manufactured by Tosoh Corp.), at a temperature of 40° C., using a tetrahydrofuran solution of 0.25% by weight as a sample solution, and using an infusion dose of 100 mL of the sample solution. The peak-top molecular weight was evaluated based on a molecular weight at a peak of the molecular weight distribution curve obtained. In addition, a weight average molecular weight Mw and a number average molecular weight Mn, as well as a molecular distribution exponent (Mw/Mn: hereinafter also referred to as merely "Mw/Mn") representing a rate of the weight average molecular weight to the number average molecular weight, were evaluated based on the molecular weight distribution curve obtained. Note that a molecular weight correcting curve was created by using standard polystyrene.

[Softening Temperature of Binder Resin and Kneaded Material]

A softening temperature of a binder resin and a kneaded material used in the following examples and comparative examples was measured by the following. The softening temperature was evaluated by using a flow characteristic evaluation apparatus (trade name: FLOW TESTER CFT-500C, manufactured by Shimazu Corp.), inserting a sample of 1 gram into a cylinder, heating the sample at a temperature increasing rate of 6° C. per minute (6° C./min) while applying a load of 10 kgf/cm$^2$ (0.980665 MPa) so as to push the sample out of a dye, and measuring a temperature when half the sample was flown out of the dye. The dye having a diameter of 1 mm and a length of 1 mm was used.

[Glass Transition Temperature (Tg) of Binder Resin]

A glass transition temperature (Tg) of the binder resin used in the following examples and comparative examples was measured according to the following. A DSC curve was measured by using a differential scanning calorimeter (trade name: DSC220, manufactured by Seiko Instruments Inc.), and heating a sample of 1 gram at a temperature increasing rate of 10° C. per minute (10° C./min) in conformity with Japanese Industrial Standards (JIS) K7121-1987. The glass transition temperature (Tg) was evaluated from a temperature of a point at the intersection of a straight line, elongated from a base line on a high temperature side of a heat absorbing peak corresponding to a glass transition of the DSC curve obtained in a direction toward a low temperature side, with a tangent line to a point having a maximum grade with respect to the curve from its rising portion to the peak.

[Melting Point Tm of Release Agent]

The DSC curve was evaluated by using the differential scanning calorimeter (trade name: DSC210, manufactured by Seiko Instruments Inc.), and repeating two times an operation in which a temperature of a sample of 1 gram is increased at a rate of 10° C. per minute from 20° C. to 200° C. and then decreased at a rate of 10° C. per minute from 200° C. to 20° C. Temperatures at a peak of melting heat were evaluated with respect to two DSC curves obtained respectively, and an average value of both temperatures was defined as a melting point of a release agent.

[Acid Number of Binder Resin]

An acid number was measured by a neutralizing titration method according to the following. Titration was conducted by dissolving a sample of 5 grams into a tetrahydrofuran solution of 50 mL, adding a few drops of an ethanol solution of phenolphthalein, and then using a potassium hydroxide (KOH) solution of 0.1 mol/L. The acid number (mgKOH/g) was evaluated based on an amount of the potassium hydroxide solution required and a weight of the sample applied for the titration until the sample solution was changed from a colorless fluid to a purple fluid as an end point.

[Tetrahydrofuran Insoluble Component of Binder Resin]

A tetrahydrofuran (abbreviated as THF) insoluble component of the binder resin was measured according to the following. A component soluble in THF contained in a sample (hereinafter referred to as a THF soluble component) was extracted by inputting the sample of 1 gram in a filter paper thimble to a Soxhlet extractor, using tetrahydrofuran of 100 mL as a solvent, heating the sample under reflux for 6 hours. A weight W (gram) of the THF soluble component was evaluated by removing the solvent from an extract containing the THF soluble component extracted, and then drying the THF soluble component at a temperature of 100° C. for 24 hours. A ratio P (% by weight) of the THF insoluble component that is a component insoluble in THF contained in the binder resin was defined by the following expression (1) based on the weight W (gram) of the THF soluble component and a weight (1 gram) of the sample used for the measurement. Hereinafter, this ratio P is referred to as the THF insoluble component.

$$P(\%\text{ by weight})=\{1\text{ (gram)}-W\text{ (gram)}\}/1\text{ (gram)}\times 100 \quad (1)$$

[Loss Tangent and Loss Elastic Modulus G" of Kneaded Material]

A loss tangent and a loss elastic modulus G" used in the following examples and comparative examples were measured according to the following by using a viscoelastic measuring apparatus (trade name: Reopolymer, manufactured by REOLOGICA Instruments AB Corp.) with a parallel plate. The loss tangent and the loss elastic modulus G" were measured at intervals of 0.5° C. by placing a sample in the parallel plate having a diameter of 25 mm, fusing the sample at a temperature of 150° C., and then setting a distance of the parallel plate to 1.0 mm, and applying a strain providing a sine wave vibration in a circumferential direction of the parallel plate with a strain of 0.5 and an angular frequency of 0.1 Hz ($0.1\pi\approx 0.628$ [rad/s]) to vibrate the sample at a sine wave angular frequency of 0.1 Hz, and increasing a temperature at a rate of 3° C. per minute from 60° C. to 200° C. A loss tangent-temperature characteristic curve showing a relationship between the loss tangent and a temperature, and a loss elastic modulus-temperature characteristic curve showing the relationship between the loss elastic modulus G" and a temperature were evaluated from measured values. A temperature range in which the loss tangent reaches a setting loss tangent value A of 0.5 or more and less than 5.0 was evaluated from the loss tangent-temperature characteristic curve obtained. In addition, a temperature range in which the loss tangent modulus G" reaches $10^3$ Pa or more and $10^5$ Pa or less was evaluated from the loss elastic modulus-temperature characteristic curve.

[Volume Average Particle Diameter and Variation Coefficient]

A volume average particle diameter $D_{50}$ and a variation coefficient CV were measured by using a particle size distribution measuring apparatus (trade name: Coulter Multisizer II, manufactured by Beckman Coulter Inc.). A measured particle count was taken as 50,000 counts and an aperture diameter was taken as 100 μm. The variation coefficient means that the smaller the value is, the narrower a particle size distribution is.

[Preparation of Water]

In the following examples and comparative examples, ion-exchange water having conductivity of 1 μS/cm was used for preparing a disperser-containing water-based medium and cleaning colorant-containing resin particles (toner particles). The ion-exchange water was prepared from tap water by using ultrapure water production apparatus (trade name: MINIPURE TW-300RU, manufactured by Nomura Micro Science Co., Ltd.). The conductivity of the ion-exchange water was measured by using LACOM TESTER EC-PH-CON10 (trade name, manufactured by Iuch Seieido).

Example 1

[Kneading Step]

A toner composition containing: as a binder resin, 890 parts by weight of a polyester resin A (a glass transition temperature of 56.7° C., a peak-top molecular weight of 12,500, Mw/Mn=2.5, an acid number of 16, a softening temperature of 102° C., and a THF insoluble component of 0%), as a colorant, 50 parts by weight of C.I. pigment blue 15:3 (trade name: BLUE No. 26, manufactured by Daiichi Seika Co.), 10 parts by weight of a charge control agent (trade name: BONTRON E84, manufactured by Dainichi Seika Co.), as a release agent, 50 parts by weight of a wax (trade name: TOWAX161, manufactured by Towa Chemical Industry Co., Ltd.), was mixed and dispersed for three minutes by a blending machine (trade name: HENSCHEL MIXER, manufactured by Mitsui Mining Co.) to produce a raw material mixture. The raw material mixture was then kneaded by a two-axis extruder (trade name: PCM-30, manufactured by Ikegai Co., Ltd) with a cylinder setting temperature of 110° C., a barrel rotation number of 300 revolutions per minute (300 rpm), and a supply rate of the raw material mixture of 20 kg/hour, to produce a kneaded material A. The softening temperature of the kneaded material A obtained was 105° C.

[Water-Based Medium Preparing Step]

As a disperser, a water soluble polymer: styrene-α-styrene-acrylic acid copolymer ammonium salt (trade name: JONCRYL 61J, manufactured by Jonson Polymer Co., a weight average molecular weight of 13,000, and a number average molecular weight of 3,700) was mixed and dissolved so as to achieve a solid content concentration of 5% by weight, to prepare a disperser-containing water-based medium. The weight average molecular weight and the number average molecular weight of the disperser were identical to those of the binder resin in this measurement.

[Granulating Step]

The obtained kneaded material A of 100 parts by weight and 900 parts by weight of the obtained disperser-containing water-based medium (a concentration of the disperser is 5% by weight) were mixed and put into the container 2 of an emulsifying machine (trade name: CLEAMIX, manufactured by M. Technique Co., Ltd.) having a configuration identical to that of the granulating apparatus 1 of FIG. 2 as described above. The mixture was heated while agitating the mixture by the rotor 5 at 5,000 revolutions per minute (5,000 rpm) until an indication of the thermometer 14 indicating a temperature of the disperser-containing water-based medium approximately identical to that of the kneaded material in the container 2 reached 85° C. as a granulating temperature shown in Table 1. In the embodiment, the screen 4 was used as a stator without being rotated. In addition, the rotor 5 having a blade member having a maximum external diameter of 35 mm was used. When an indication of the thermometer 14 had reached 85° C., a rotation number of the rotor 5 was increased up to 15,000 revolutions per minute (15,000 rpm), and the mixture was agitated for 10 minutes while heating the mixture so as to maintain a temperature of the thermometer 14 of 85° C., and the kneaded material A was dispersed into the dispersing-containing water-based medium to produce toner particles. Accordingly, a water dispersion of the toner particles was obtained. The granulating temperature of 85° C. in the embodiment is a temperature at which a loss tangent of the kneaded material A reaches 2.0.

[Cooling Step]

After the mixture had been agitated for 10 minutes at a temperature of 85° C. as described above, heating by the heater 13 was stopped and the water dispersion of the toner particles was cooled until an indication of the thermometer 14 reached 30° C. while agitating the water dispersion. The rotation number of the rotor 5 at a cooling step was taken as 8,000 revolutions per minute (8,000 rpm).

[Separating Step, Cleaning Step and Drying Step]

The cooled water dispersion of the toner particles was filtered to separate a solid content (hereinafter also referred to as an "aqueous filtered material") containing the toner particles. The aqueous filtered material separated had ion-exchange water having conductivity of 1 μS/cm and a temperature of 25° C. added to be dispersed and then filtered once again. Accordingly, the toner particles were cleaned. A cleaning operation of the toner particles was repeated until the conductivity of washing water that had been used for washing the toner particles, that is, filtrate reached 10 μS/cm or less. In the embodiment, the cleaning operation was repeated twice. The toner particles after cleaned were freeze-dried to obtain a toner.

Example 2

The same procedure as in Example 1 was followed except that the granulating temperature at the granulating step was changed to 95° C., to obtain a toner. The granulating temperature of 95° C. in the embodiment is a temperature at which the loss tangent of the kneaded material A reaches 3.0.

Comparative Example 1

The same procedure as in Example 1 was followed except that the granulating temperature at the granulating step was changed to 105° C., to obtain a toner. The granulating temperature of 105° C. in the embodiment is a temperature at which the loss tangent of the kneaded material A reaches 5.0.

Example 3

At the kneading step, the same procedure as in Example 1 was followed except that a polyester resin B (a glass transition temperature of 53.0° C., a peak-top molecular weight of 5,940, Mw/Mn=14.5, an acid number of 7.7, a softening temperature of 115° C., and a THF insoluble component of 0%) was used as a binder resin, to produce a kneaded material B. The softening temperature of the kneaded material B was 135° C.

The same procedure as in Example 1 was followed after the granulating step except that at the granulating step, the kneaded material was used instead of the kneaded material A and the granulating temperature was changed to 100° C., to obtain a toner. The granulating temperature of 100° C. in the embodiment is a temperature at which the loss tangent of the kneaded material B reaches 0.7.

Example 4

The same procedure as in Example 3 was followed except that the granulating temperature at the granulating step was changed to 120° C., to obtain a toner. The granulating temperature of 120° C. in the embodiment is a temperature at which the loss tangent of the kneaded material B reaches 2.0.

Comparative Example 2

The same procedure as in Example 3 was followed except that the granulating temperature at the granulating step was changed to 140° C., to obtain a toner. The granulating temperature of 140° C. in the embodiment is a temperature at which the loss tangent of the kneaded material B reaches 5.5.

[Evaluation]

Characteristics of the toners produced in Example 1 to 4 and Comparative Examples 1 and 2 were evaluated according to the following.

[Shape of Toner Particles]

A spherical degree was measured with respect to 1,000 particles of the obtained toner by using a flow type particle image analyzer (trade name: FPIA-2000, manufactured by Sysmex Corp.). An average value was then calculated from these spherical degrees to obtain an average spherical degree. The spherical degree is defined by the following expression (2) and takes a value of 1 or less, using a projection image of particles detected by the above-described flow type particle image analyzer. The average spherical degree means that the nearer the value is 1, the nearer the particle shape is a true spherical shape.

[Expression 1]

$$\text{Spherical Degree}=(\text{Circumferential Length of Circle Having Same Area As Projection Image Of Particle})/(\text{Circumferential Length Of Projection Image Of Particle}) \quad (2)$$

The average spherical degree was used as an evaluation index of a shape of the toner particles to evaluate a shape of the toner particles based on the following criteria:

OK: Good, the average spherical degree is from 0.90 to 0.97.

NG: Failure, the average spherical degree is less then 0.90, or more than 0.97.

[Cleaning Property]

A continuous printing test was performed by inputting the obtained toner into a developer tank of a developing device of a testing image forming apparatus, adjusting an amount of the toner attached to a recording sheet before fixed to be 0.5 $mg/cm^2$, and continuously forming a testing chart with printing density of 5% including a solid part for 10,000 pages of the recording sheet. As the testing image forming apparatus, there was used a commonly available image forming apparatus (trade name: Digital Full-Color Complex Machine AR-150, manufactured by Sharp Corp.) in which the developing device thereof was modified for a nonmagnetic one-component developer. As the recording sheet, a full-color-intended sheet (part number: PP106A4C) was used.

After the continuous printing test, it was determined whether toner filming was found or not by observing a surface of a photoreceptor using an optical microscope. The cleaning property was evaluated as Good (OK) when no toner filming was found, and as Failure (NG) when the toner filming was found.

Table 1 shows evaluation results according to the above description.

TABLE 1

| | Kneaded material | | | Toner Particle Shape | | |
|---|---|---|---|---|---|---|
| | Type | Loss Tangent at Granulating Temp. | Granulating temp. (° C.) | Average Spherical Degree | Result | Cleaning Property |
| Ex. 1 | A | 2.0 | 85 | 0.93 | OK | OK |
| Ex. 2 | A | 3.0 | 95 | 0.97 | OK | OK |
| Comp. Ex. 1 | A | 5.0 | 105 | 0.99 | NG | NG |
| Ex. 3 | B | 0.7 | 100 | 0.94 | OK | OK |
| Ex. 4 | B | 2.0 | 120 | 0.96 | OK | OK |
| Comp. Ex. 2 | B | 5.5 | 140 | 0.99 | NG | NG |

Based on comparison between Examples 1, 2 and Comparative Example 1, and comparison between Examples 3, 4 and Comparative Example 2, it is found that toner particles having an approximately spherical shape can be manufactured by setting the granulating temperature as a temperature of a water-based medium at the granulating step to a temperature at which the loss tangent value of the kneaded material measured at a setting frequency of 0.1 Hz reaches the setting loss tangent value A of 0.5 or more and less than 5.0 to define the average spherical degree of the toner particles as a value of from 0.90 to 0.97. In addition, it is found that the toner composed of the toner particles having the approximately spherical shape in Examples 1 to 4 has the average spherical shape of more than 0.97, and is excellent in the cleaning property, compared with the toner composed of the toner particles having a shape more similar to the true spherical shape in Examples 1 and 2.

As described above, the toner particles having the approximately spherical shape was readily manufactured by setting the granulating temperature as a temperature of the water-based medium at the granulating step to a temperature at which the loss tangent value of the kneaded material obtained at the kneading step reaches the setting loss tangent value A, specifically, a value of 0.5 or more and less than 5.0.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for manufacturing a toner comprising:

a kneading step for heating and melt-kneading a toner composition containing at least a binder resin and a colorant to produce a kneaded material in which at least the colorant is dispersed in the binder resin; and a granulating step for mixing the kneaded material with a water-based medium, and then a mixture obtained is heated to disperse the kneaded material into the water-based medium in a state in which the kneaded material is softened, wherein a granulating temperature at the granulating step is set to a temperature at which a loss tangent obtained by dividing a loss elastic modulus G" of the kneaded material by a storage elastic modulus G' reaches a loss tangent value A of 0.5 or more and less than 5.0, the loss tangent being measured at a setting frequency of 0.1 Hz, thereby a toner composed of toner particles whose average spherical degree is 0.90 or more and 0.97 or less is obtained.

2. The method of claim 1, wherein the granulating temperature at the granulating step is adjusted to a temperature at which the loss elastic modulus G" of the kneaded material reaches a range of from $10^3$ Pa to $10^5$ Pa at a setting frequency of 0.1 Hz.

3. The method of claim 1, wherein the toner composition further comprises a release agent, wherein the granulating temperature at the granulating step is lower than a melting point of the release agent.

* * * * *